US006837512B2

(12) United States Patent
Long

(10) Patent No.: US 6,837,512 B2
(45) Date of Patent: Jan. 4, 2005

(54) APPARATUS FOR IMPROVING HUMAN MOBILITY ON SNOW SURFACES

(76) Inventor: David M. Long, 1852 E. Westminster Ave., Salt Lake City, UT (US) 84108

( * ) Notice: Subject to any disclaimer, the term of this patent is extended or adjusted under 35 U.S.C. 154(b) by 0 days.

(21) Appl. No.: 09/998,813

(22) Filed: Oct. 24, 2001

(65) Prior Publication Data

US 2003/0075901 A1 Apr. 24, 2003

(51) Int. Cl.[7] ..... A63C 5/00
(52) U.S. Cl. ..... 280/604
(58) Field of Search ..... 280/604, 614, 280/615, 809, 625, 609

(56) References Cited

U.S. PATENT DOCUMENTS

| | | | | |
|---|---|---|---|---|
| 2,162,888 A | * | 6/1939 | Held et al. | 280/604 |
| 2,326,802 A | * | 8/1943 | Robinson et al. | 280/604 |
| 3,506,279 A | * | 4/1970 | Lambert | 280/604 |

(List continued on next page.)

FOREIGN PATENT DOCUMENTS

| | | | |
|---|---|---|---|
| CH | 118246 | * | 12/1926 |
| CH | 479205 | * | 2/1929 |
| CH | 173785 | * | 3/1938 |
| CH | 223797 | * | 4/1943 |
| CH | 637839 | * | 8/1983 |
| DE | 197808 | * | 8/1978 |
| DE | 3039898 | * | 5/1982 |
| DE | 3624597 | * | 2/1987 |
| DE | 4309488 | * | 9/1994 |
| EP | 0 334 299 A1 | | 9/1989 |
| EP | 0 492 498 B1 | | 7/1992 |
| EP | 0 579 975 B1 | | 1/1994 |
| JP | 61-118441 | | 6/1986 |
| JP | 1-146568 | * | 6/1989 |

OTHER PUBLICATIONS

"An Adventure with UpSki, Blue Peak, Corn and Wind." www.upski.com/up01000.htm May 14, 2001.

Brochure for SkiSail. www.skiseil.no/brochure.htm May 14, 2001.

Black Diamond Equipment, Ltd. Backcountry Accessories product description. www.bdel.com/backcountry/bindings access.html Aug. 9, 2001.

"Tracing Footprints All Over the Mountain." Merriam, Dave and Mike Porter. Professional Ski Instructors of America. www.psia.org/Education/TPSArticles/newtechnologies/ tpsfall99footprints.htm Fall 1999 (printed Aug. 10, 2001).

Prior Snowboard Manufactory Ltd. product description of Splitboard. www.priorsnowboards.com/split.html Oct. 1, 2001.

American Non–Slip Products, Inc. product information. www.americannonslip.com Jun. 29, 2001.

(List continued on next page.)

*Primary Examiner*—Bryan Fischmann
(74) *Attorney, Agent, or Firm*—Clayton, Howarth & Cannon, P.C.

(57) ABSTRACT

An apparatus for improving human mobility on snow or other icy surfaces when a skier or other user is utilizing a snow-traveling device. In one embodiment of the invention, the apparatus includes an assembly comprising a body with an multiple slots formed therein and an aperture formed therein to allow a snow-traveling device to pass therethrough, a crampon structure with elongated teeth for protruding into the snow surface, and a tightening band introduced through the slots of the body for tightening the apparatus to the snow-traveling device. Another embodiment contains system for changing the crampon structure with a convex rudder structure for increasing stability and control. Also disclosed is a disposable friction enhancing fabric that can be attached to various snow-traveling devices for increasing the friction between the snow contacting surface of a snow-traveling device and the snow surface.

18 Claims, 16 Drawing Sheets

U.S. PATENT DOCUMENTS

| | | | | |
|---|---|---|---|---|
| 3,612,557 | A | | 10/1971 | Berlenbach |
| 3,927,896 | A | | 12/1975 | Detoia |
| 4,045,890 | A | | 9/1977 | D'Alessandro et al. |
| 4,095,813 | A | | 6/1978 | Hall |
| 4,288,092 | A | | 9/1981 | Mukri |
| 4,666,178 | A | | 5/1987 | Matthews |
| 4,844,501 | A | | 7/1989 | Lekhtman |
| 5,052,708 | A | | 10/1991 | Matthews |
| 5,591,509 | A | | 1/1997 | Lorenz et al. |
| 5,649,722 | A | * | 7/1997 | Champlin ..... 280/818 |
| 5,740,621 | A | | 4/1998 | Wing et al. |
| 5,823,563 | A | | 10/1998 | Dubuque |
| 6,105,281 | A | | 8/2000 | Wing et al. |
| 6,105,990 | A | | 8/2000 | Sutherland |
| 6,216,624 | B1 | | 4/2001 | Page |
| 6,220,631 | B1 | | 4/2001 | Pritchard et al. |
| 6,471,234 | B2 | * | 10/2002 | Ayliffe ..... 280/604 |

OTHER PUBLICATIONS

S & S Plastics, Inc. product and service information. www.ssplastics.com/home.html Aug. 9, 2001.
Outside Online review of Voil´´ Split Decision Snowboard. www.outsidemag.com/magazine/1199/199911review7.html Nov. 1999 (printed Oct. 1, 2001).
Product description of Skegedge from Powder Magazine.

* cited by examiner

APPARATUS FOR IMPROVING HUMAN MOBILITY ON SNOW SURFACES

BACKGROUND OF THE INVENTION

1. The Field of the Invention

The present invention relates generally to apparatus for improving human mobility on congealed precipitation, such as snow, and which can be used in conjunction with devices adapted to operate on congealed precipitation. More particularly, the present invention relates to apparatus used to assist cross country skiers by increasing traction in different snow conditions.

2. Description of Related Art

The history of winter sports, in particular skiing, dates back to the thirteenth century or perhaps earlier when skiing was not a past time or any type of sport, but was a necessary mode of transportation. Skiing takes its roots from the northern countries of Scandinavia where armies took advantage of skis to move across the frozen tundra of the north. In time, armies began holding races to memorialize certain historic ski trips made by previous armies or scouts. Soon the general public became fascinated with the ski movement and eventually became involved in the army ski races. Since those early times, winter sports have substantially increased in popularity.

In the United States particularly, winter sports have been ever increasing in popularity since the 1830's when Scandinavian immigrants introduced snow-skiing. Later in the late 1840's miners involved in the gold rush situated in Western North America began using skis as a mode of travel. Soon after, these miners began using their make-shift skis in spur of the moment downhill competitions during their spare time because of the thrill of the experience. Not long after, these impromptu races developed into formal ski events and races, where enthusiasts began developing skis and ski accessories into what they have become today, technologically advanced systems.

The enthusiasm for all winter sports has increased tremendously over the past thirty years with the advent of new technologies and material advancements. For instance, ski equipment has been improved by use of carbon fiber, GORTEX™, titanium, and KEVLAR™. Today, participation in skiing and other snow related sports has increased at a tremendous pace and the numbers of winter sports enthusiasts continues to climb at an increasing rate. Literally millions of people flock to ski resorts and the back country each winter to enjoy the thrill of winter sports.

Enthusiasm for winter sports continues to grow each winter season around the world as evidenced by the record number of athletes that participated in the 1998 Winter Olympic Games in Nagano, Japan. Seventy-two countries and two thousand one hundred seventy-seven athletes participated at the games in Nagano giving it the highest participation rate in Winter Olympic history. The popularity of winter sports is further evidenced by the number of events that will be included in the 2002 Winter Olympic Games in Salt Lake City, Utah, United States. A total of seventy-eight events will be competed in by over seventy countries in the 2002 Winter Olympic Games.

In the context of cross country skiing, there is a great deal of interest in equipping skis and other snow-traveling devices with accessories that offer an adaptability to changing terrain conditions. It is common practice for certain types of skiers to travel over rough snow covered mountains and hills. In addition, it is common to experience a multitude of snow conditions, including steep slopes, ice covered mountains, and uneven terrain.

With the confrontation of changing terrain conditions, there are situations that demand the skier to equip his/her skis with additional accessories in order to assist the skier to navigate changing terrain conditions.

It is recognized in the industry, when climbing steep, icy slopes, that hiking with crampons, a climbing device connected to the soles of a climber's boots having a prong or several prongs which are used for sinking into an icy surface to gain traction, is a safe alternative to climbing with skis. However, hiking with crampons requires the removal of skis and replacement with crampons. Using crampons requires the skier to carry heavy, bulky accessories during the ski trip and also requires the skier to carry his/her skis up the slope when using crampons.

Even other alternative methods to climbing on skis, such as that disclosed in U.S. Pat. No. 5,823,563 (granted Oct. 20, 1998 to Dubuque) for removable ski bindings that convert into crampons, are disadvantageous because the skis still must be carried up the snowy, icy slope by the skier. In certain skiing situations, it is an advantage to be able to quickly install and remove ski accessories in order to climb instead of removing the skis to climb a snow covered mountain. Without the aid of traction-providing accessories, the ability of a skier to effectively maneuver in hard, icy snow conditions is limited.

Other methods have been developed to aid the skier when climbing slippery inclines. In the past, certain sea mammals had been recognized as having the ability to slither up snow covered slopes and slide down the other side with great ease and efficiency. Strips of those mammals' hides were used to help cross country skiers duplicate the ease and efficiency of climbing up slopes while sliding down the other side. These hides or skins (hereinafter referred to as "climbing skins") were attached to the underside of the skis where the climbing skin surface articulates with the snow or ice to permit skiers to climb up one side and then glide down the other side of a hill.

Today, climbing skins have been replaced with woven fabrics with a slant pile (hereinafter referred to as "climbing fabrics"). Climbing fabrics are typically treated with a latex or plastic sealant to keep them dry in wet snow conditions. These climbing fabrics are particularly useful for wilderness and cross country skiing in mountainous areas where slopes are too steep for effective use of waxes (a system of applying wax to the ski in order to increase the friction between the ski and the snowy surface by creating a temporary bond between the wax and the snow to aid in traction) and other climbing methods. However, climbing fabrics have traditionally been expensive to purchase and requires attachment of permanent accessories to connect the climbing skins to the skis.

Although different procedures and mechanisms have been developed to aid the snow traveler in extreme conditions, such procedures and mechanisms have proven to be too permanent, bulky and cumbersome especially when used in icy or snowy conditions where the traveler is carrying a heavy pack. For cross country skiing, in particular, it is important to have the ability to easily and quickly mount and remove ski accessories because of the dramatic changes which can take place in the weather and snow conditions experienced on cross country ski trips. Additionally, it is important to provide for small, light weight accessories that will easily fit within a small pack or pocket permitting the skier to carry all necessary equipment for multiple, unexpected terrain conditions.

Attempts have been made in the industry to provide alternatives for maneuvering through different snow conditions. However, none of the undertakings in the industry specifically considers the advantage of attaching and detaching a device in a quick, easy and efficient manner. For example, U.S. Pat. No. 6,220,631 (granted Apr. 24, 2001 to Pritchard et al.) discloses a stabilizing skeg structure that requires mounting the skeg structure onto the ski traveling device, such as a snowboard. This device is characterized by several disadvantages, including the process for mounting which requires permanently placing holes into the snowboard or other snow-traveling device. The Pritchard device is designed such that even when the device is removed, holes are exposed in the snow-traveling device which is not aesthetically desirable and changes the performance of the snow-traveling device and leaves the Pritchard device unadaptable to changing conditions, including climbing steep hills.

There are several other snow-traveling device accessories known in the industry, such as that disclosed in U.S. Pat. No. 6,105,990 (granted Aug. 22, 2000 to Sutherland). This patent discloses a system for mounting climbing fabric to a ski which allows the climbing fabric to be put on and taken off. However, the Sutherland device is expensive to manufacture and costly for consumers. In addition, the climbing fabric is not disposable, adding to the cost of the end product because the fabric is required to be extremely durable in order to withstand the coarse conditions the fabric encounters. Because the fabric is meant to be used over and over, it is made of a material which is expensive to manufacture and sell.

It will be appreciated that the industry has not recognized the need for providing a disposable climbing fabric. Significantly, previously available climbing fabrics are unable to withstand the coarse conditions encountered during use. In the past, disposable climbing fabrics were not available which could both achieve the features of a traditional climbing fabric and be produced in a cost effective manner.

Another snow-traveling device accessory known in the industry, which is described in U.S. Pat. No. 3,927,896 (granted Dec. 23, 1975 to Detoia), provides a ski and snow shoe device with retractable cleats, which allows the ski to be treated interchangeably as a ski or snow shoe device. However, the Detoia device is a permanent fixture of the ski, and the Detoia device must be fitted to a specifically prepared ski with open slots, which damages the ski during installation and such damage is exposed when the device is removed. In addition, the Detoia ski and snow shoe device undesirably increases the weight of the ski.

Yet another snow-traveling device accessory known in the industry, disclosed in U.S. Pat. No. 5,823,563 (granted on Oct. 20, 1998 to Dubuque), provides a binding with a harness and attachment assembly that incorporates a crampon that can be removed from the ski to be used selectively as a crampon in order to simplify the shift between ski and crampon. However, the crampon is connected to a binding and use of the Dubuque device assumes that there are times when individuals would not use skis to climb, but instead, for safety reasons, prefer to use a separate crampon system for climbing separated from their skis. The Dubuque device does not anticipate instances where the cross country skier would prefer to climb slopes without removing his/her skis. Rather, the Dubuque device requires ski removal and the consequent carrying of the skis up the mountain by the skier, which is a severe disadvantage to the skier.

As mentioned above, significant disadvantages are present in the industry. For instance, the inability to quickly and easily remove equipment is a limiting factor during ski trips. Another disadvantage unrecognized in the industry is the bulky size of the existing components which must be carried during ski trips and used in place of skis in order to climb hills, slopes and other inclines. The inability of the previously existing devices to be removed from the ski because of being permanently attached, is yet another disadvantage of the accessories known in the industry. In addition, the accessories in the available art have traditionally been expensive to manufacture.

Therefore, there has been a long unrecognized need in the industry for small, light weight, quickly assembled, and portable accessories for snow-traveling devices which are inexpensive to make, and simple in operation. In view of the drawbacks inherent in the available art, it would be a significant advance in the art to provide small and lightweight ski accessories to improve human mobility on snow surfaces that can be easily mounted and removed by the skier.

BRIEF SUMMARY OF THE INVENTION

The available art is thus characterized by several disadvantages that are addressed by the present invention. The present invention minimizes, and in some aspects eliminates, the above-mentioned failures, and other problems, by utilizing the methods and structural features described herein.

The present invention provides an apparatus for improving human mobility on snow or other icy surfaces when a skier or other user is utilizing a snow-traveling device. In one illustrative embodiment, the apparatus includes an engagement assembly for engaging the snow-traveling device, a protrusion assembly for protruding into a mass of snow or ice, and a fastener assembly for fastening the engagement assembly on the snow-traveling device such that the protrusion assembly can be selectively held in place and removed from the snow-traveling device by the skier or user during the course of an excursion.

The engagement assembly may comprise an upper wall and a lower wall for engaging the snow-traveling device and for gripping the snow-traveling device and securing the engagement assembly to the snow-traveling device in any one of a plurality of desirable positions on the snow-traveling device.

The protrusion assembly may comprise an elongated member engaging the snow surface for enhancing the maneuverability of the snow-traveling device.

The fastener assembly may comprise an aperture formed in said engagement assembly for allowing the snow-traveling device to pass through there through, a tightening band introduced through a tightening band slot allowing the tightening band to be inserted into a connector, wherein the tightening band is snugly tightened causing a wall of the engagement assembly to contact the snow-traveling device thereby securing the engagement assembly to the snow-traveling device in a precise position desired by the user and in a manner which can be readily removed when desired.

In accordance with another aspect of the present invention, a disposable climbing fabric, and an accompanying method of using the same, is disclosed. The disposable climbing fabric is attached to the snow contacting surface of a snow-traveling device, for example a cross country ski, to increase the amount of friction between the ski and the snow surface, such as when climbing hills. The disposable climbing fabric is compact enough to keep stored until needed when it is easily installed and is inexpensive enough to be discarded after a single use.

Additional advantages which are provided by the present invention will be set forth in the description which follows, and in part will be apparent from the description, or may be learned by the practice of the invention without undue experimentation. The advantages of the invention may also be realized and obtained by means of the instruments and combinations particularly pointed out in the appended claims.

BRIEF DESCRIPTION OF THE DRAWINGS

The above described features and advantages of the present invention will become apparent from a consideration of the subsequent detailed description presented in connection with the accompanying drawings in which.

DETAILED DESCRIPTION OF THE ILLUSTRATIVE EMBODIMENTS

Figure 1:
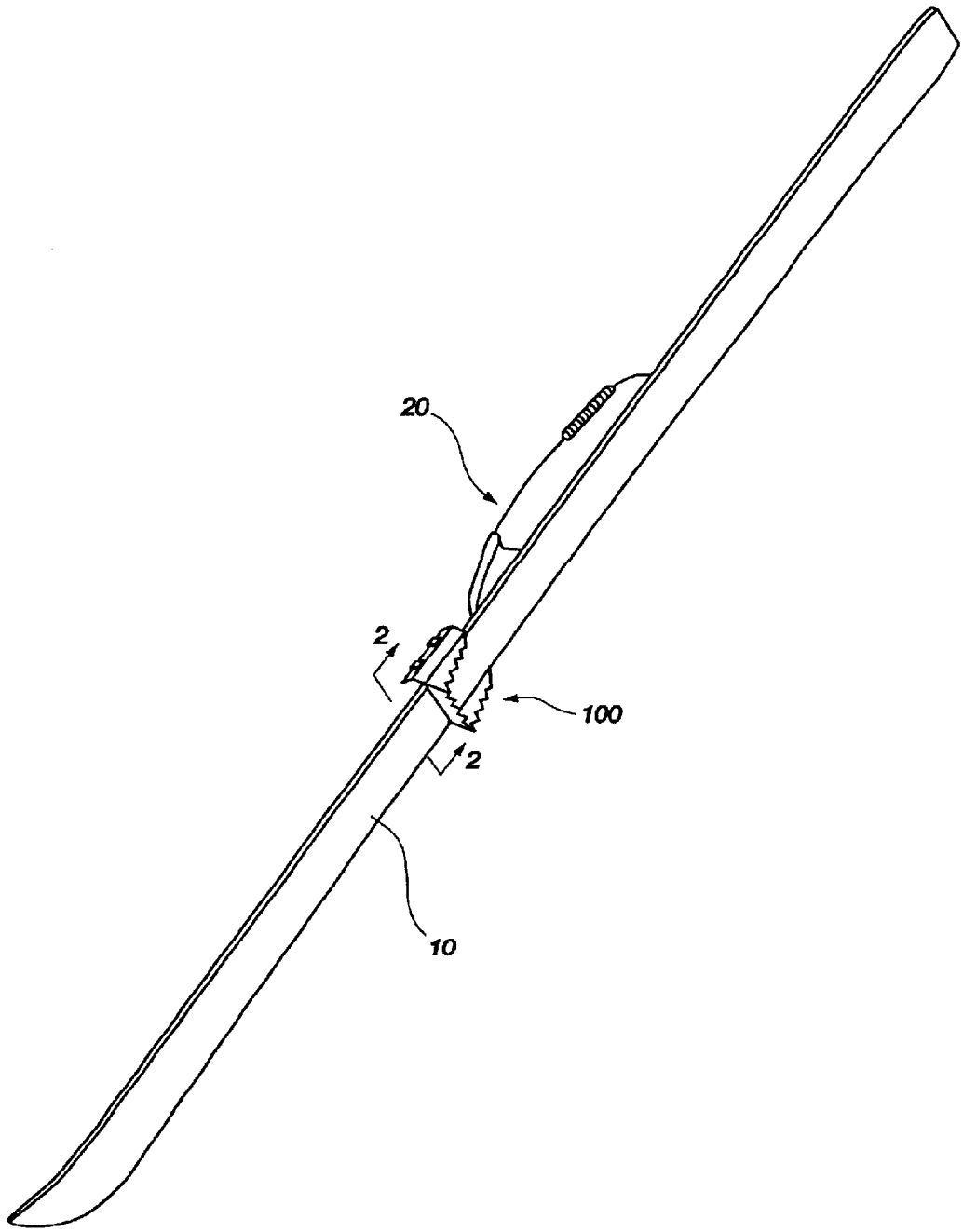
FIG. 1 is a perspective view of a first embodiment of the present invention showing the relative position of the first embodiment with an exemplary ski.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Before the presently illustrative embodiments of the invention are disclosed and described, it is to be understood that this invention is not limited to the particular configurations, process steps, and materials disclosed herein as such configurations, process steps, and materials may vary. It is also to be understood that the terminology employed herein is used for the purpose of describing particular embodiments only and is not intended to be limiting since the scope of the present invention will be limited only by the appended claims and equivalents thereof.

It must be noted that, as used in this specification and the appended claims, the singular forms "a," "an," and "the" include plural referents unless the context clearly dictates otherwise.

In describing and claiming the present invention, the following terminology will be used in accordance with the definitions set out below.

As used herein, "comprising," "including," "containing," "characterized by," and grammatical equivalents thereof are inclusive or open-ended terms that do not exclude additional, unrecited elements or method steps.

As used herein, "congealed precipitation" includes, but is not necessarily limited to snow, compacted snow, powder, compacted powder, machine groomed snow, hard pack snow, wet snow, wet pack snow, loose granular, frozen granular, wet granular, variable conditions, spring conditions, corn snow, new over snow, windblown snow, ice, compacted ice, and melted ice, and similar conditions.

As used herein "snow-traveling device" refers to any structure or apparatus used to mobilize a human over congealed precipitation including, but not necessarily limited to, cross-country skis, downhill skis, all mountain skis, all terrain skis, free skis, freeride, mid-fat skis, groomed snow skis, powder skis, freestyle skis, extreme carving skis, racing skis, skiboards, backcountry skis, track skis, telemark skis, randonee skis, mountaineering skis, alpine skis, skating skis, freestyle boards, freeride boards, and alpine or carving boards and devices performing equivalent functions.

In accordance with the present invention, it has been discovered that climbing hills and maneuvering over snow covered terrain is greatly enhanced by the use of traction enhancing accessories that can easily be attached and detached from a pair of skis or other snow-traveling device. In accordance with the present invention, the embodiments of the present invention are lightweight, durable, easily transported in a small pack or pocket, and in the case of some embodiments, disposable.

In accordance with the present invention, snow-traveling device accessories are used to improve human mobility on congealed precipitation. The snow-traveling device accessories of the present invention are capable of being attached and detached from a snow traveling device and are lightweight and small enough to be easily transported when not being used. The features of the present invention provide significant improvements over the previously available devices. While specific devices known in the industry may provide one individual beneficial feature, none of the known devices provide the beneficial combination of features provided by the present invention.

The features of the present invention will be illustrated through different embodiments by reference to the figures. The figures illustrate at least five different embodiments of the invention, and like structures represented in the figures will be designated with like reference numerals.

FIG. 1 shows the relative placement and size of the apparatus, generally referred to at 100, in relation to a snow-traveling device, particularly a ski 10. FIG. 1 illustrates the apparatus 100 as the first, illustrative embodiment of the present invention attached to a ski 10. Also shown is a binding 20 attached to the ski 10, as is known in the industry. Advantageously, the first embodiment can be attached and detached without damaging the snow-traveling device, such damage being caused by placing holes in the snow-traveling device to permanently affix hardware to the snow-traveling device. As will be appreciated, doing permanent damage to the snow-traveling device is not advantageous when the hardware being attached is removed or replaced with another, different piece of hardware. Thus, the first embodiment of the present invention, when attached and detached, advantageously does not cause damage to a ski 10 or other snow-traveling device.

Figure 2:
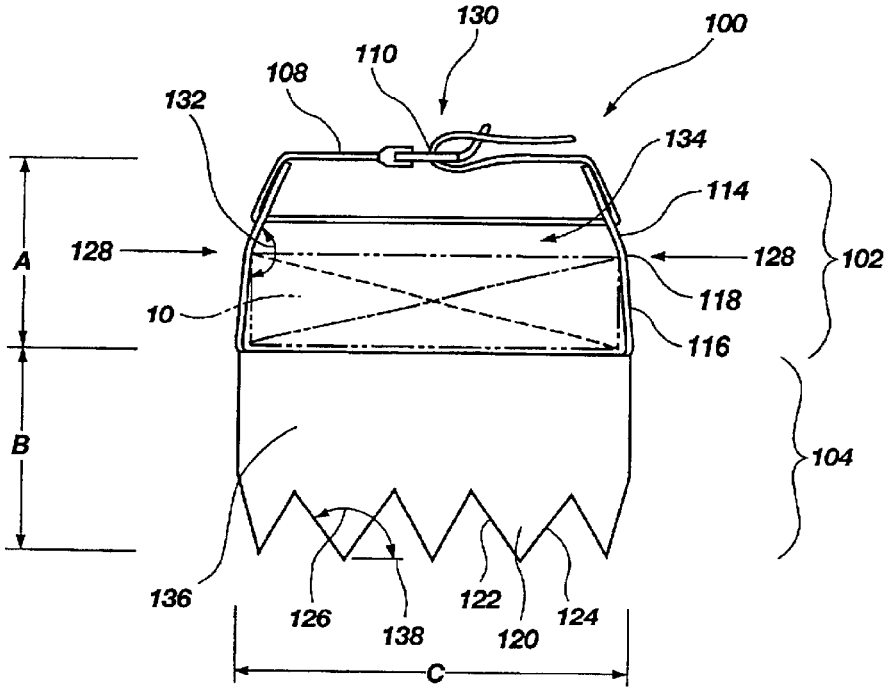
FIG. 2 is a front view of the first embodiment of the present invention taken along line 2—2 of FIG. 1, wherein a cross section of a ski is shown to indicate the positioning of the first embodiment on the ski.

FIG. 2 provides a cross sectional view of the first embodiment, taken along the line 2—2 in FIG. 1, and shows the particularities of the present invention. For illustrative purposes only, the described embodiments of the present invention will be described using ski 10 but it is to be appreciated that other snow-traveling devices may be used in connection with the present invention.

The apparatus of the first embodiment of the present invention, generally indicated at 100 in FIG. 1, comprises three main components, an engagement assembly indicated at bracket 102, a protrusion assembly indicated at bracket 104 and a fastener assembly, generally referred to at 130. The engagement assembly 102 further consists of an upper wall 114 and a lower wall 116, being separated by a bend 118. The upper wall 114 and the lower wall 116, when combined with other members of the fastener assembly 130, form an aperture, generally referred to at 134. The ski 10 or other snow-traveling device is inserted between the walls which form the aperture 134 of the apparatus 100. Once the ski 10 has been inserted through the aperture 134, the apparatus 100 is tightened to grip the ski 10 by interaction between the fastener assembly 130 and the upper wall 114, the lower wall 116 and the bend 118 of the engagement assembly 102.

The bend 118 is composed of an angle 132 that can be supported by a range of angles from about 90 to about 180 degrees. A more illustrative angle 132 includes a range from about 100 to about 165 degrees. The most illustrative angle 132 for the bend 118 is between a range of about 110 to about 160 degrees. The two upper walls 114 contact the ski 10 when the engagement assembly 102 is tightened using the tightening band 108, holding the position on the ski 10.

As tightening occurs, the bend 118 allows the engagement assembly 102 to contact the ski 10. The tightening and subsequent contacting generally occurs in the direction of arrows 128 which indicate the engagement assembly 102 closing in and contacting the ski 10.

It is to be appreciated that the engagement assembly 102 is one illustrative example of an engagement means for engaging the snow-traveling device. Moreover, the engagement assembly 102 is one example of possible structures, within the scope of the present invention, which function to interact with other members of the apparatus 100 allowing a snow-traveling device to pass through an aperture 134, thus contacting the walls or edges of the apparatus 100 to grasp the snow-traveling device when tightened. It will be appreciated that the engagement assembly 102 disclosed herein is merely one example of a structure for contacting and grasping the ski-traveling device and it should be appreciated that any structure, apparatus or system for removably attaching a structure which increases friction between a snow covered surface and a snow-traveling device which performs functions the same as, or equivalent to, those disclosed herein are intended to fall within the scope of the present invention.

Figure 4:
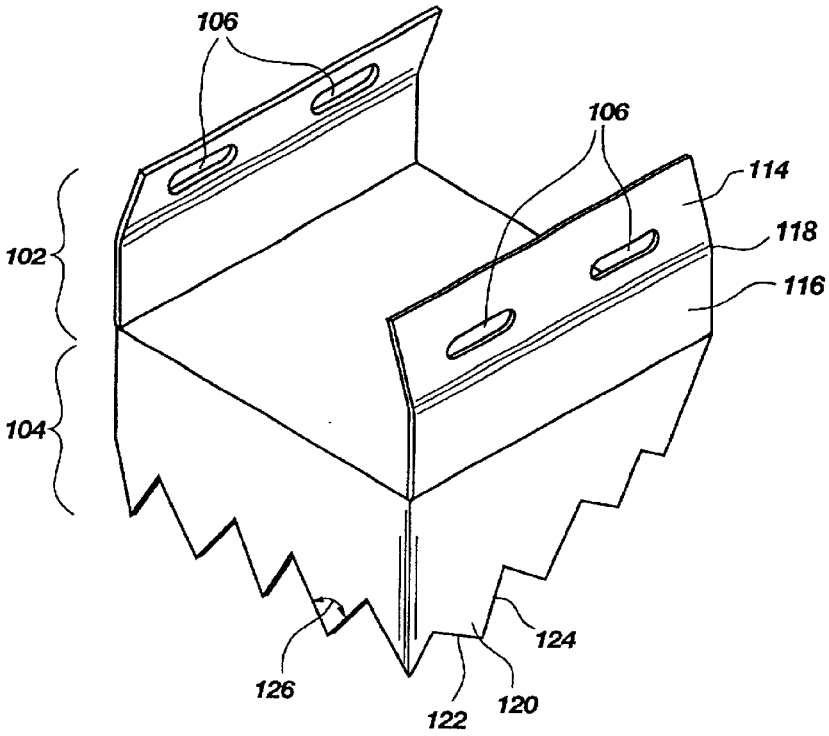
FIG. 4 is a perspective view of the first embodiment represented in FIGS. 1 and 2 without the tightening bands which are illustrated in FIGS. 1 and 2.
Figure 5:
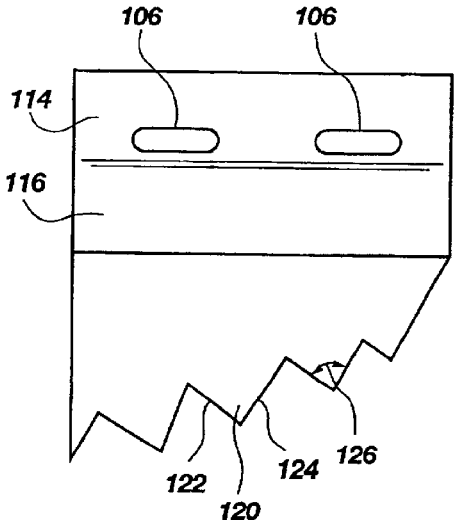
FIG. 5 is a side view of the first embodiment of the apparatus represented in FIG. 4.

The fastener assembly 130 further includes the tightening band 108 (seen best in FIG. 3), tightening band slots 106 (seen best in FIGS. 4 and 5), and a buckle connector 110. The fastener assembly 130 allows the engagement assembly 102 to be attached and detached to a ski 10.

Figure 3:
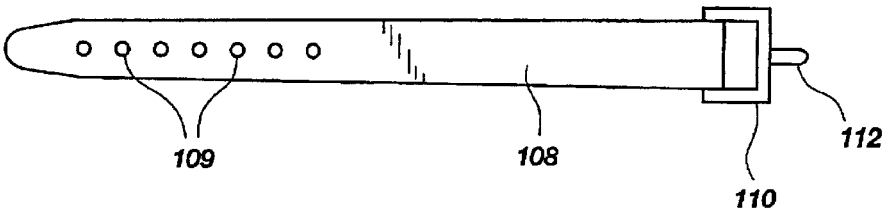
FIG. 3 is a detailed view of the tightening band used to fasten the first embodiment represented in FIGS. 1 and 2 to the ski or other snow traveling device.

Referring now to FIGS. 2 and 3, attachment of the engagement assembly 102 to the ski 10 is accomplished by inserting the tightening band 108 through tightening band slots 106 (shown best in FIGS. 4 and 5) and looping the tightening band 108 around the upper portion of the engagement assembly 102 into a buckle connector 110 where a pin 112 is inserted into a preset hole 109 in the tightening band 108 for fastening the engagement assembly 102 onto a ski 10 or other device.

Figure 6:
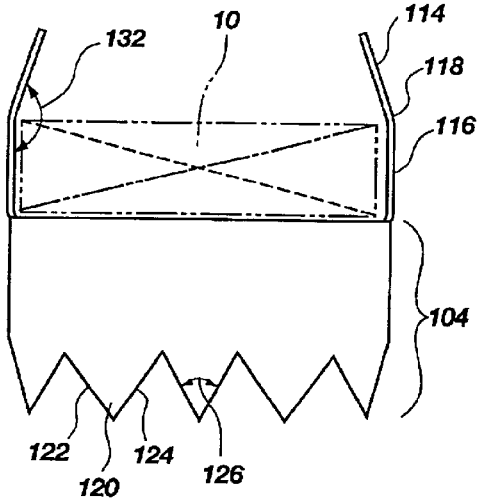
FIG. 6 is a front view of the first embodiment of the present invention, wherein a cross section of a ski is shown to indicate the positioning of the first embodiment on the ski.

Within the scope of the present invention, another arrangement for the fastener assembly 130 can advantageously be utilized. In such an alternative arrangement, the same structures are used, that is, a tightening band 108, tightening band slots 106, and a buckle connector 110. In the alternative arrangement, however, fastening occurs when the tightening band 108 is inserted through the tightening band slots 106 (seen best in FIGS. 4–6), looped around the upper portion of the engagement assembly 102 (see FIG. 2) and woven through the buckle connector 110 instead of being secured by a pin 112 being inserted into preset holes 109 (seen best in FIG. 3). By weaving the tightening band 108 through the buckle connector 110, the tightening band 108 may be easily pulled to achieve the desired amount of tension to firmly grip the ski 10. In addition, variable selections for tightening are permitted, thus allowing the flexibility of one apparatus to fit a range of ski sizes. Each engagement assembly 102 supports two separate tightening bands 108 thereby securing the engagement assembly 102 effectively to the ski 10 without movement or slippage.

The fastener assembly, generally referred to at 130, is one example of a means for fastening the engagement means in a first position on the snow-traveling device in accordance with the present invention and functions to interact with the upper portion of the engagement assembly 102, tightening band slots 106, multiple tightening bands 108, and multiple buckle connectors 110 used for tightening and securing the engagement assembly 102 to the snow-traveling device. It will be appreciated that the system for fastening disclosed herein is merely one example of accomplishing the securing of the engagement assembly to the snow-traveling device, other suitable arrangements known or readily ascertainable, to those skilled in the art, may be used and are within the scope of the present invention.

The protrusion assembly 104 further comprises an elongated member 136 provided with a plurality of teeth, one of which is indicated at tooth 120, which together function as a protuberance that are capable of digging into snow in its various forms, but most advantageously hard, icy snow. Thus, the configuration of the tooth 120 enhances the ability of a skier or other user to climb icy, snowy hills. The illustrative embodiment just described is advantageous because it utilizes the teeth, such as tooth 120, in conjunction with skis or other snow-traveling devices, whereas other apparatuses known in the industry, such as hiking crampons, are used as free standing components which attach to a user's boots and cannot be used in conjunction with skis or other snow-traveling devices.

Referring again to FIG. 2, the tooth 120 of the protrusion assembly 104 may itself have several different arrangements. The tooth 120 is further composed of a first side 122 and a second side 124. A tooth angle 126 is formed between the first side 122 and the second side 124 of the tooth 120. The tooth angle 126 is measured from the horizontal axis, which horizontal axis designated by the line 138.

In accordance with the present invention, there is a range of effective tooth angles 126 which may be incorporated into the tooth 120. For example, one range of the tooth angle 126 is between about 180 and about 0 degrees. For example, a tooth 120 that is in reality a single tooth with two sides, each having about a 90 degree angle, may be utilized by having a very sharp, blade-like edge. The blade-like edge allows for digging into congealed surfaces and is intended to be within the scope of the present invention. A more illustrative tooth angle 126 range is between about 150 degrees and about 20 degrees, and the most illustrative range of tooth angle 126 is between about 120 degrees and about 30 degrees. Other tooth angles 138 and other shapes for the protrusion assembly 104 can be used in accordance with the present invention.

It will be appreciated that the protrusion assembly generally referred to at 104 is one illustrative structure for functioning as a protrusion means for protruding into a mass of congealed precipitation. The protrusion assembly 104, is one example of a structure within the scope of the present invention, which functions to interact with the engagement assembly 102 wherein the structure itself is in contact with and projects into the congealed precipitation surface when being used by a user. It will be appreciated that the protrusion assembly 104 disclosed herein is merely one example of a structure for protruding into a mass of the congealed precipitation and it should be appreciated that any structure, apparatus or system for protruding into a mass of the congealed precipitation which performs functions the same as, or equivalent to, those disclosed herein are intended to fall within the scope of the present invention.

By placing one or more of the first embodiment of the present invention 100 onto each ski 10, more maneuverability and control can be conveniently achieved than was possible with the use of previously available apparatus. Desirably, when using the apparatus 100 of the present invention, the result is an enhanced capability of climbing icy slopes with skis intact much more easily and safely than possible with previously available devices.

Another example of a snow-traveling device which can benefit from the embodiment of the present invention, such as apparatus 100, is a snowshoe. Snowshoes are often essential when walking across deep snow any substantial distance. Many people who regularly travel in snow covered country via motor vehicle, snowmobile, and even small aircraft carry snowshoes in the event they become stranded due to an accident or mechanical failure and must walk out across deep snow to obtain assistance. Using snowshoes in the back country can be advantageous for climbing directly up a slope, but can also be dangerous when a user is attempting to negotiate, when either ascending or descending, a hill sideways or diagonally. Disadvantageously, previously available snowshoes cannot adequately grip the surface of the congealed precipitation except when the snowshoe is in particular orientations in relation to the slope to be negotiated. For that reason, it will be appreciated that the embodiments of the present invention, and particularly the first embodiment of the present invention, described herein may be adapted for use on snowshoes to provide the desirable function of increasing friction, improving traction and allowing a snowshoe user to more easily and safely ascend or descend a slope or incline.

After completing a climb utilizing any snow-traveling device, the apparatus 100 can readily be detached and stored in a day pack, and another accessory, for example the apparatus with a convex rudder 350 (seen best in FIG. 9), may be attached to the ski 10, if desired by the user. Thus, mobility on congealed precipitation surfaces is improved with the ease of attaching and detaching the apparatus onto a ski 10.

Figure 7:
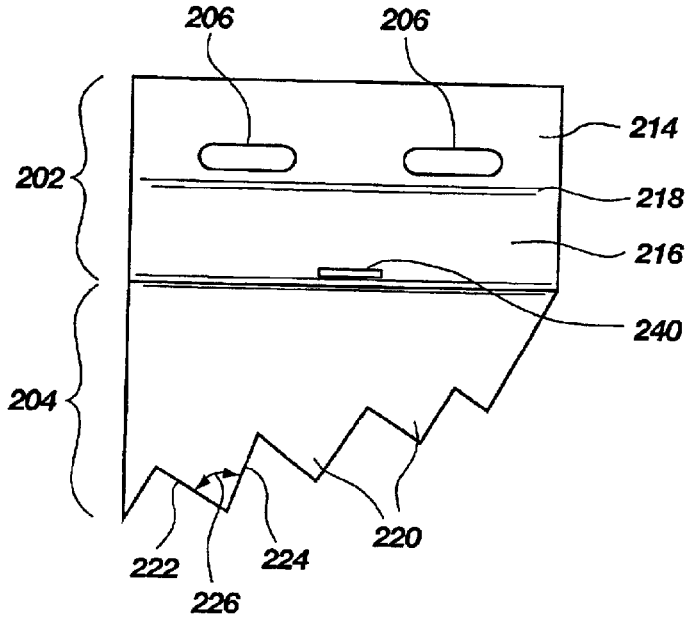
FIG. 7 is a side view of the second embodiment of the present invention, similar to the first embodiment illustrated in FIG. 5, further including structures for attaching variable protrusion assemblies.

A second illustrative embodiment of the present invention is shown in FIG. 7, which will now be described. The second illustrative embodiment includes nearly all of the structures which are included in the first illustrative embodiment previously described, with the inclusion of structures which allow the protrusion assembly 204 to be replaced by another different type of protrusion assembly 204 by way of an interchange mechanism schematically represented by box 240. Those skilled in the art can readily implement structures to carry out the function of an interchange mechanism using the information provided herein.

It will be appreciated that the structure of the second illustrative embodiment of the present invention allows many different structures to be included as the protrusion assembly 204 to greatly enhance mobility of a user on congealed precipitation surfaces in accordance with the condition of the congealed precipitation and the activity in which the user is engaged. For example, as seen best in FIGS. 8–11, the teeth 220 may be replaced with a convex rudder 350. The protrusion assembly 204 is positioned onto the engagement assembly 202 of the apparatus such that one type of structure, such as the teeth 220, may be substituted for the other, such as the convex rudder 350.

The interchange mechanism schematically represented by box 240 in FIG. 7 can be carried out by a number of different structures which function to securely grasp one protrusion assembly 204 and allow it to be selectively replaced with another different type of protrusion assembly 204. For example, by connecting a convex rudder 350 (see FIGS. 8–11) to the engagement assembly 202 (instead of teeth 220), the present invention is capable of adapting itself to changing terrain or different snow conditions. The replacement may be accomplished using the described interchange mechanism schematically represented by the box 240, which preferably includes a member that allows the protrusion assembly 204, including either the teeth 220 or the convex rudder 350, to be detached from the engagement assembly 202. Sliding the teeth 220 out from the engagement assembly 202 and replacing it with the convex rudder 350 is accomplished via the interchange mechanism 240.

It is within the scope of the present invention to position a structure similar to the convex rudder 350 (see FIGS. 8–11) in place onto the second embodiment (represented in FIG. 7) invention via the interchange mechanism 240, wherein both the engagement assembly 202 and the protrusion assembly 204 contain structures which comprise the interchange mechanism 240. Attachment preferably occurs by sliding a structure similar to the convex rudder 350 into place by way of fitted grooves, similar to those which might be used in a desk drawer, until the convex rudder 350 is completely locked into place. A locking mechanism is used to keep a structure similar to the convex rudder 350 in place while in use and a release mechanism is used to allow the replacement structure to be slid out when finished or to be replaced with another type of protrusion assembly 204. It will be appreciated that other suitable arrangements known or readily ascertainable, to those skilled in the art, may be used to accomplish similar results and are within the scope of the present invention.

Figure 8:
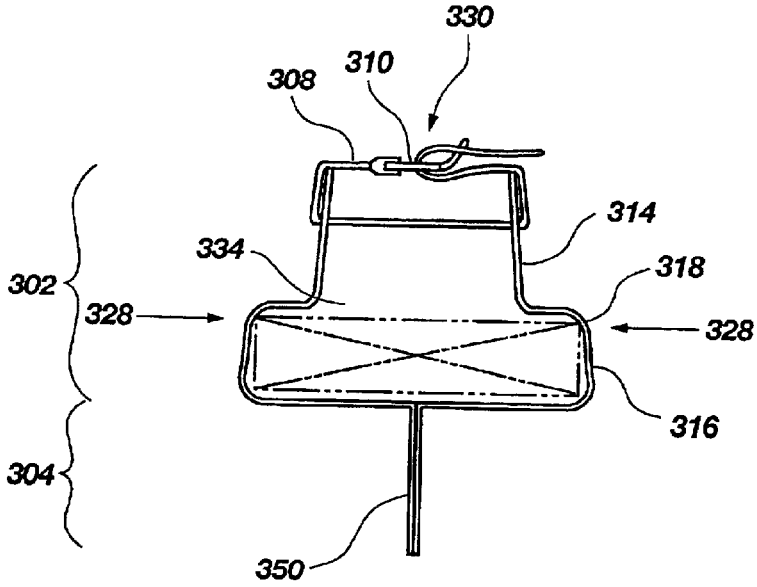
FIG. 8 is front view of a third embodiment of the present invention, wherein a cross section of a ski is shown to indicate the positioning of the second embodiment on the ski.

A third illustrative embodiment of the present invention, which will now be described by reference to FIGS. 8–11, has similar structures that function similarly as the corresponding structures described in connection with the first embodiment, however, the third illustrative embodiment utilizes different arrangements for both the engagement assembly, indicated at bracket 302, and the protrusion assembly, indicated at bracket 304. FIG. 8 illustrates the engagement assembly, at bracket 302, with a bend 318 and an upper wall 314 and a lower wall 316. Additionally, FIG. 8 shows the fastener assembly, generally indicated at 330, with its component parts, the tightening band slots 306 (seen best in FIGS. 9 and 10), tightening band 308 and the buckle connector 310, all of which function essentially the same as the corresponding structures described in connection with the first embodiment. An engagement plane is indicated by the double arrows marked with reference numeral 328.

The protrusion assembly 304 includes a convex rudder 350, which enhances stability in less-than-ideal snow conditions when it is more difficult to control snow traveling devices, such as cross country skis, because the skis are unable to gain traction and cut through the icy surface. The convex rudder 350 cuts into the icy surface allowing the ski (such as ski 10 represented in FIG. 1) to allow the user to more easily maintain control on icy snow.

The protrusion assembly, indicated at bracket 304 in FIG. 8, in the different embodiments of the present invention may be fabricated to provide different heights and dimensions depending upon the conditions encountered. A protrusion assembly 304 with a greater height, extending in the downward direction toward the ground, is capable of protruding deeper into the congealed precipitation and advantageously improves stabilization. Alternatively, fabricating the protrusion assembly 304 with a shorter height is desirable in other snow conditions.

For example, when parasailing with snow skis 10, it will be advantageous to have the convex rudder 350 penetrate more deeply into the congealed precipitation to provide added stability when cross-winds occur so that the user does not have to expend undue energy to maintain a desired course. In view of the advent of sport of parasailing, where a skier propels himself on skies using a wind driven sail, the use of the present invention will advantageously assist both those persons learning to parasail with snow skis and those who have substantial experience with the sport. Further, a convex rudder 350 which penetrates more deeply into the snow or ice surface will be very useful when a user is laterally negotiating steeper slopes.

Moreover, it will be understood that the positioning of the embodiments of the present invention on the snow-traveling device provides advantages not previously available. For example, under many commonly encountered surface conditions the embodiment of the present invention with the convex rudder 350 is advantageously located just behind the heel of the user on the snow-traveling device, such as the ski 10. It is important to note that not only can the protrusion assembly 304 be adjusted in its height and dimension, but the apparatus of the present invention 100 itself may also be positionally adjusted on the ski 10 or other snow-traveling device in order to allow the user to freely move the apparatus 100 to a desired position. Likewise, the other protrusion assemblies (such as the protrusion assembly 104 in FIG. 2) of the present invention may contain various heights depending upon the conditions encountered. Thus, because the different embodiments of the protrusion assembly 304 contain various heights and dimensions, and because the apparatus 100 may be adjusted and placed at various positions on a snow-traveling device, the user is able to advantageously adapt the snow-traveling device to a variety of changing conditions.

In the embodiment represented in FIGS. 8–11, the convex rudder 350 is an elongated member wherein the distal end of the protuberance is adapted to be embedded into the congealed precipitation surface for cutting through hard, icy conditions. The particular advantage imparted by use of the third embodiment of the present invention is improved maneuverability, stability and control over icy, snowy conditions as well as increased lateral stability when engaging in activities such as ski sailing.

The third embodiment of the present invention includes an engagement assembly 302 that is an inverted T-shape. An aperture 334 is formed for receiving the ski 10 to be attached to the engagement assembly 302. When the ski 10 is placed into the aperture 334, the tightening band 308 (see FIG. 8), which is inserted through the tightening band slots 306 (seen best in FIGS. 9–10), may be inserted into the buckle connector 310 whereby the engagement assembly 302 is fastened by pulling the tightening band 308 snugly, thus contacting and holding the ski 10 in place.

Figure 9:
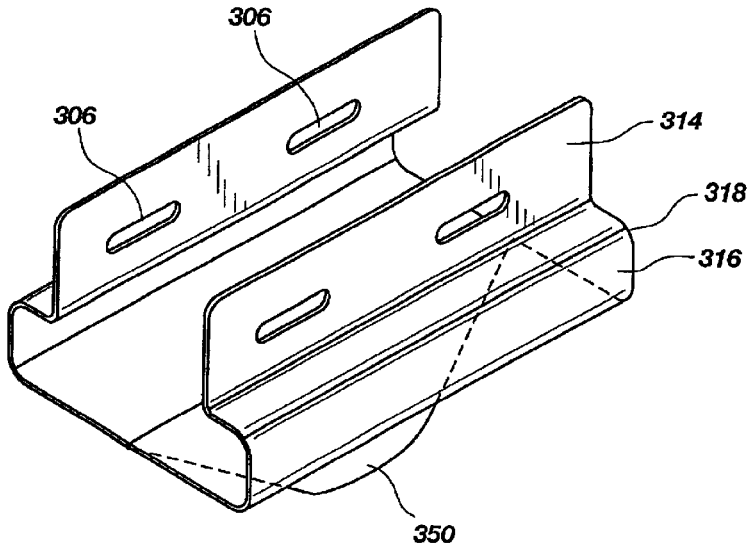
FIG. 9 is a perspective view of the third embodiment of the present invention made in accordance with the principles of the present invention.
Figure 10:
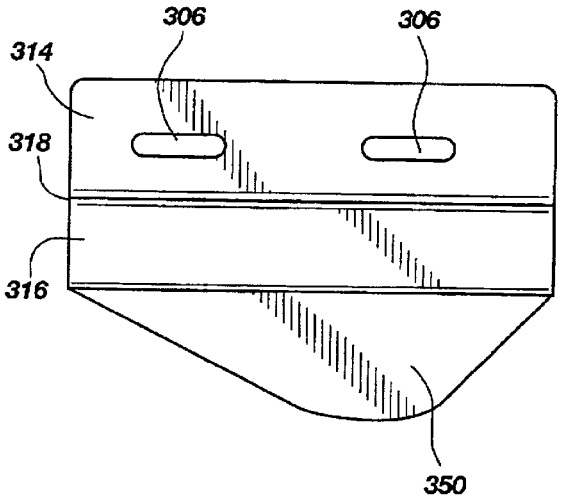
FIG. 10 is a side view of the third embodiment of the present invention.
Figure 11:
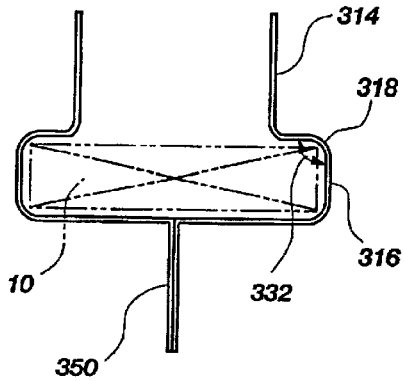
FIG. 11 is a front view of the third embodiment of the present invention, wherein a cross section of a ski is shown to indicate the positioning of the second embodiment on the ski.

FIGS. 9 through 11, are different views of the third embodiment of the present invention, and show the relative positioning of the convex rudder 350 in relation to the engagement assembly 302, the tightening band slots 306, and the ski 10 (the tightening band 308 is represented best in FIG. 8). Double arrows 332 represent the angle of engagement.

As used in the embodiments of the present invention represented in FIGS. 1–11, the term "damage," when used in connection with a snow traveling device, includes but is not necessarily limited to drilled holes, permanent holes, residual holes, left-over orifices from hardware, slits and cavities. The term "damage" is not intended to encompass a minor alteration to the snow-traveling device, but is intended to include any treatment of the snow-traveling device that significantly reduces the performance of the contacting surface.

Figure 12:
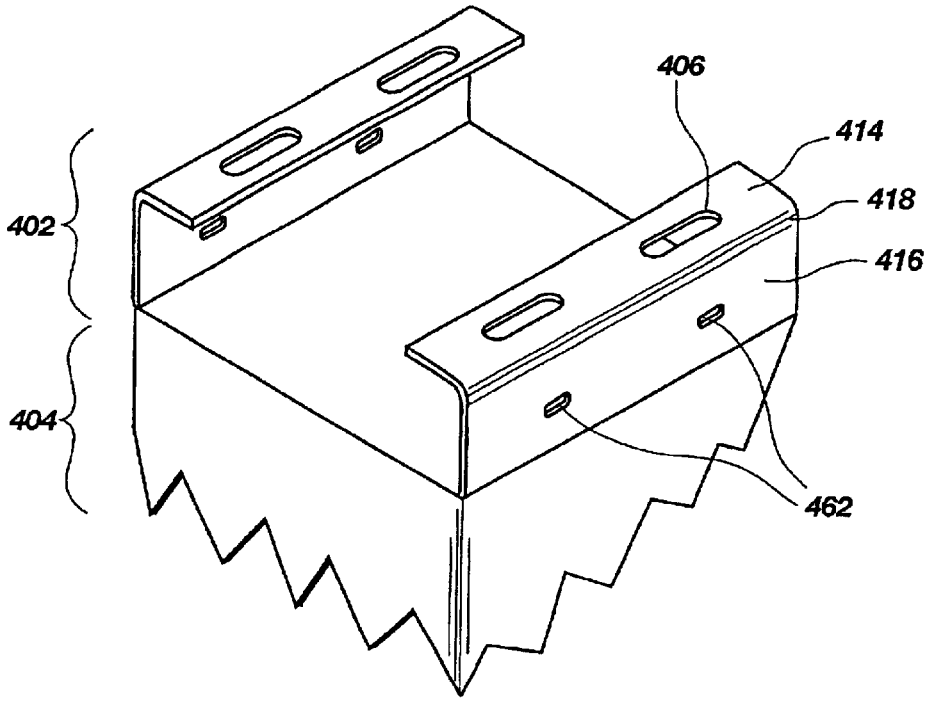
FIG. 12 is a perspective view of the fourth embodiment of the present invention, wherein slots are provided to engage the fourth embodiment to a snow-traveling device.
Figure 12A:
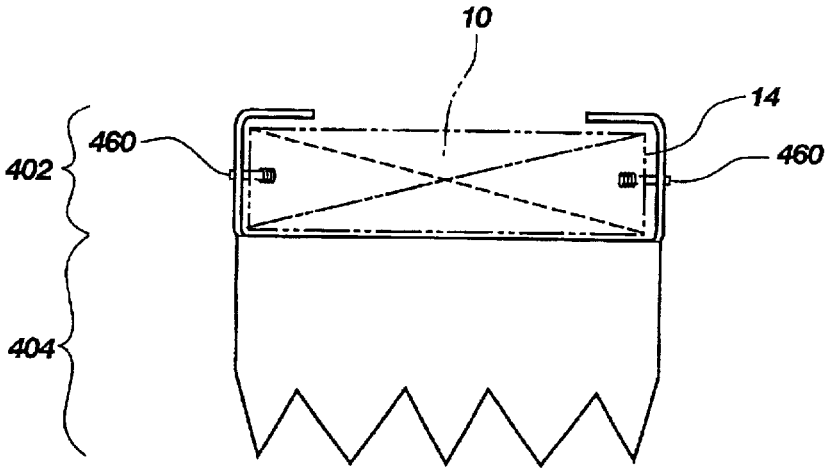
FIG. 12A is a front view of the fourth embodiment of the present invention, showing the relative placement of fourth embodiment on a ski (wherein a cross section) and the placement of positioning pegs into the ski.
Figure 13:
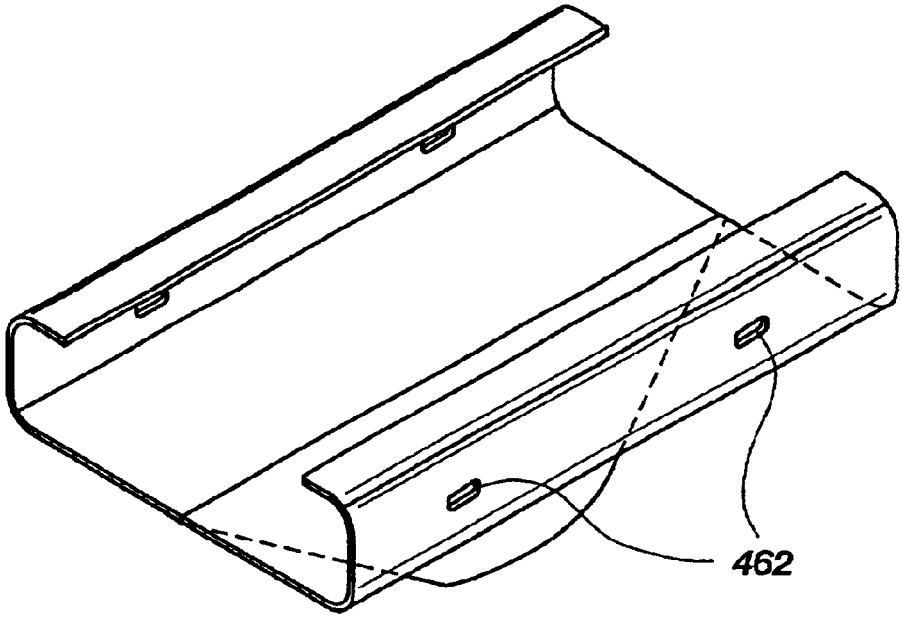
FIG. 13 is a second perspective view of the fourth embodiment of the present invention, which differs from the illustration of FIG. 12 in the inclusion of a different engagement assembly.

By examining FIGS. 12, 12A, and 13, in which the fourth illustrative embodiment of the present invention is represented, it will be appreciated that the fourth illustrative embodiment of the present invention is similar in numerous respects to the first embodiment of the present invention. Importantly, the fourth illustrative embodiment of the present invention is different than the previously described structures in that the engagement assembly, indicated at bracket 402, is fastened to the ski 10 in a different fashion. Similarly to the structure described in connection with the first embodiment, the engagement assembly 402 comprises an upper wall 414 and a lower wall 416. Further, the fourth embodiment may have an engagement assembly 402 that is similar to the corresponding structures illustrated with the first, second and third embodiments of the present invention. However, in the fourth embodiment of the present invention an alteration in the ski 10 or other snow-traveling device occurs with the fastening of the engagement assembly 402.

In the fourth embodiment of the present invention, the fastener assembly comprises a positioning peg 460 and a positioning peg slot 462. The positioning peg 460 is mounted to the outside surface 14 of the ski 10 (as shown in FIG. 12A) in a manner that does not damage the contacting surface of the ski 10 so as to not hinder the performance of the ski 10, or any other alternative snow-traveling device. The positioning peg 460 is essentially a male connector that engages a corresponding female receptor, such as a hole in the engagement assembly 404, the hole in the engagement assembly being preferably referred to as a positioning peg slot 462. When the engagement assembly 402 is slid onto the ski 10, the positioning peg 460 on the ski 10 interconnects with the positioning peg slot 462, which are biased outward, to create a match lock that can be released by pushing the positioning pegs 460 together and moving the engagement assembly 402 away from the positioning pegs 460. Those skilled in the art can arrive at modifications and arrangements of the illustrated structure which perform functions equivalent to the fastener assembly disclosed in FIGS. 12–13, and such modifications and arrangements, both those which can be devised at present and those which will be devised in the future by those skilled in the pertinent art, are intended to fall within the scope of the present invention.

It is also within the scope of the present invention to structure a fastener assembly to perform the functions of the structures represented in FIGS. 12–13 which may further take the form of a nut and bolt arrangement (not shown in the figures) to secure the engagement assembly 402 to the snow-traveling device. The described nut and bolt system does not damage the ski's (or other snow-traveling device) surface which contacts the snow (or other congealed precipitation surface), but only alters a surface(s) of the device which does not regularly contact the surface of the congealed precipitation. Other preferred forms of the fastener assembly, not shown in the figures, may include screws, rivets, a pin and notch system or other fasteners known to one with ordinary skill in the art.

Referring generally to the embodiments of the present invention represented in FIGS. 1–11, it will be appreciated by those skilled in the art that the material used in the construction of the engagement assembly, generally referred to at 102, and the protrusion assembly, generally referred to at 104, could be implemented using a variety of materials that are both light and durable. Examples of specific materials which can be used will be well known to those skilled in the industry and may be found in the literature known in the industry.

One of the illustrative processes for construction of the apparatus is to use injection molding techniques, using either plastic or metal materials. Examples of the types of materials used in the injection molding process include: thermoplastics, fiber reinforced thermoplastics, thermosetting plastics, or elastomers, stainless steel, copper, alloy steels, molybdenum, tool steels, tungsten, ferrous alloys, other specialty alloys, and custom-blend alloys used in injection molding and other materials known to one familiar in the art.

It will further be appreciated by one skilled in the art that there is a range of ski widths which a skier may choose from depending upon the performance desired, but it is to be understood that the scope of the present invention is not merely limited to snow skis. The present invention is designed to accommodate various ski widths. Several illustrative ski width ranges that the present invention is able to accommodate will now be described. It will be appreciated that the ranges disclosed herein are merely illustrative of the range of ski widths that the present invention can benefit and it should be appreciated that any structure, apparatus or system for attaching to skis which performs functions the same as, or equivalent to, those disclosed herein are intended to fall within the scope of the present invention.

An illustrative range for widths of a ski 10, which the present invention will accommodate, is within the range of about 50 to about 110 mm. A more illustrative range of ski width is from about 55 to about 100 mm, and the most illustrative range of ski width is from about 60 to about 100 mm.

Referring again to FIG. 2, the dimensions of the apparatus which are represented by A, B and C will now be discussed. The base width of the apparatus represented by C is within the illustrative range of from about 50 to about 110 mm. The height of the protrusion assembly 104, represented by B, is within the range from about 20 to about 80 mm. The height of the engagement assembly 102, represented by A, is within the range from about 20 to about 80 mm.

Advantageously, the embodiments represented by FIGS. 1–11 allow the user to position the apparatus, generally referred to at 100, in multiple positions anywhere along the length of the ski 10 the user desires, rather than in the location where permanent hardware is attached, as with other permanently attached devices.

Reference will next be made to the perspective view of FIGS. 14 and 18 which shows the fifth embodiment of the present invention attached to a ski 10. The fifth embodiment of the present invention includes a friction enhancing fabric 570 which provides the necessary traction for a skier to climb snowy slopes and inclines. The friction enhancing fabric 570 is flexible enough to be folded and utilizes an optional hoop 572 and a preferred adhesive layer 574 (seen best in FIG. 16) to connect the friction enhancing fabric 570 to the ski 10.

One advantageous aspect of the fifth embodiment of the present invention takes advantage of the preferred friction enhancing fabric 570 being inexpensive enough to be disposed of after a single use. A further advantageous aspect of the friction enhancing fabric 570 being that the material itself is durable enough for a prolonged single use or multiple shorter uses without losing its friction enhancing properties and without having its performance degraded by accumulation of ice, a condition commonly referred to as "icing-up." The friction enhancing fabric 570 of the present invention can quickly and easily be attached to the ski 10, from the ski tip 12 to the back end of ski 10, without the use of any permanently attached accessories or alterations to the ski 10.

Figure 14:
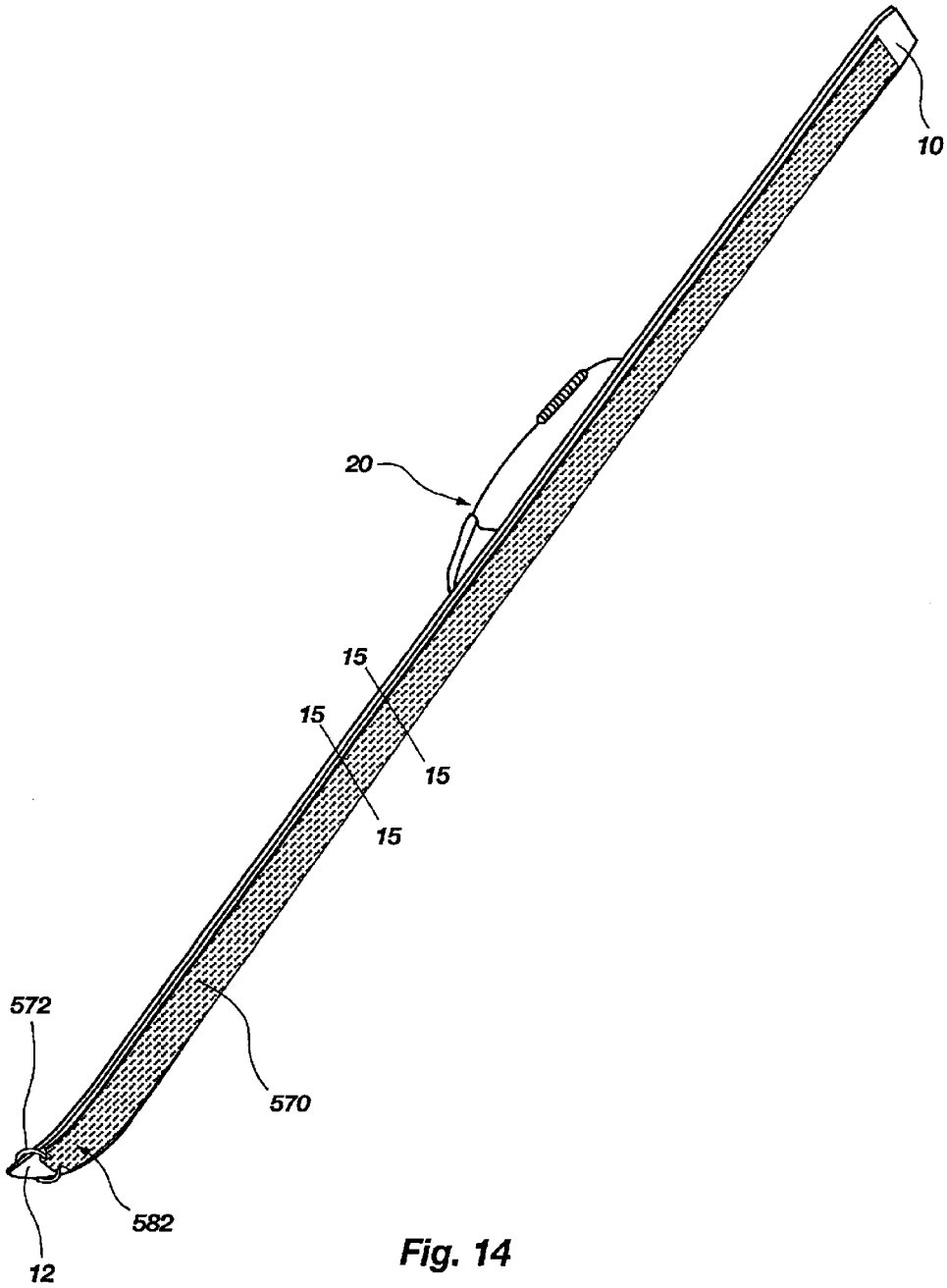
FIG. 14 is a perspective view of a fifth embodiment of the present invention shown positioned on a ski to indicate the positioning of the fifth embodiment on the ski.
Figure 16:
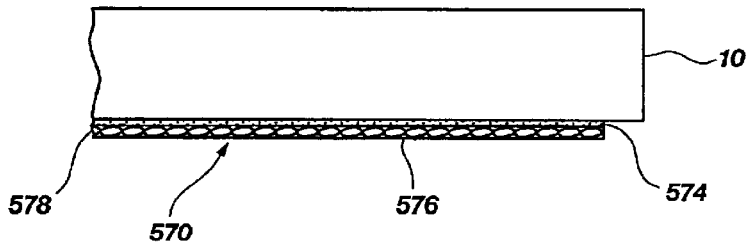
FIG. 16 is a side view of the fifth embodiment of the present invention installed on a ski.

Use of the embodiment of the present invention illustrated in FIG. 14 is preferably accomplished by placing the hoop 572 fastened to a first end 582 of the friction enhancing fabric 570 over the tip 12 of the ski and connecting the friction enhancing fabric 570 to the ski 10 via an adhesive layer 574 as clearly shown in FIG. 16. The adhesive layer 574 bonds the friction enhancing fabric 570 to the base of the ski 10 which contacts the congealed precipitation surface, until the friction enhancing fabric 570 is removed by the user.

Figure 18:
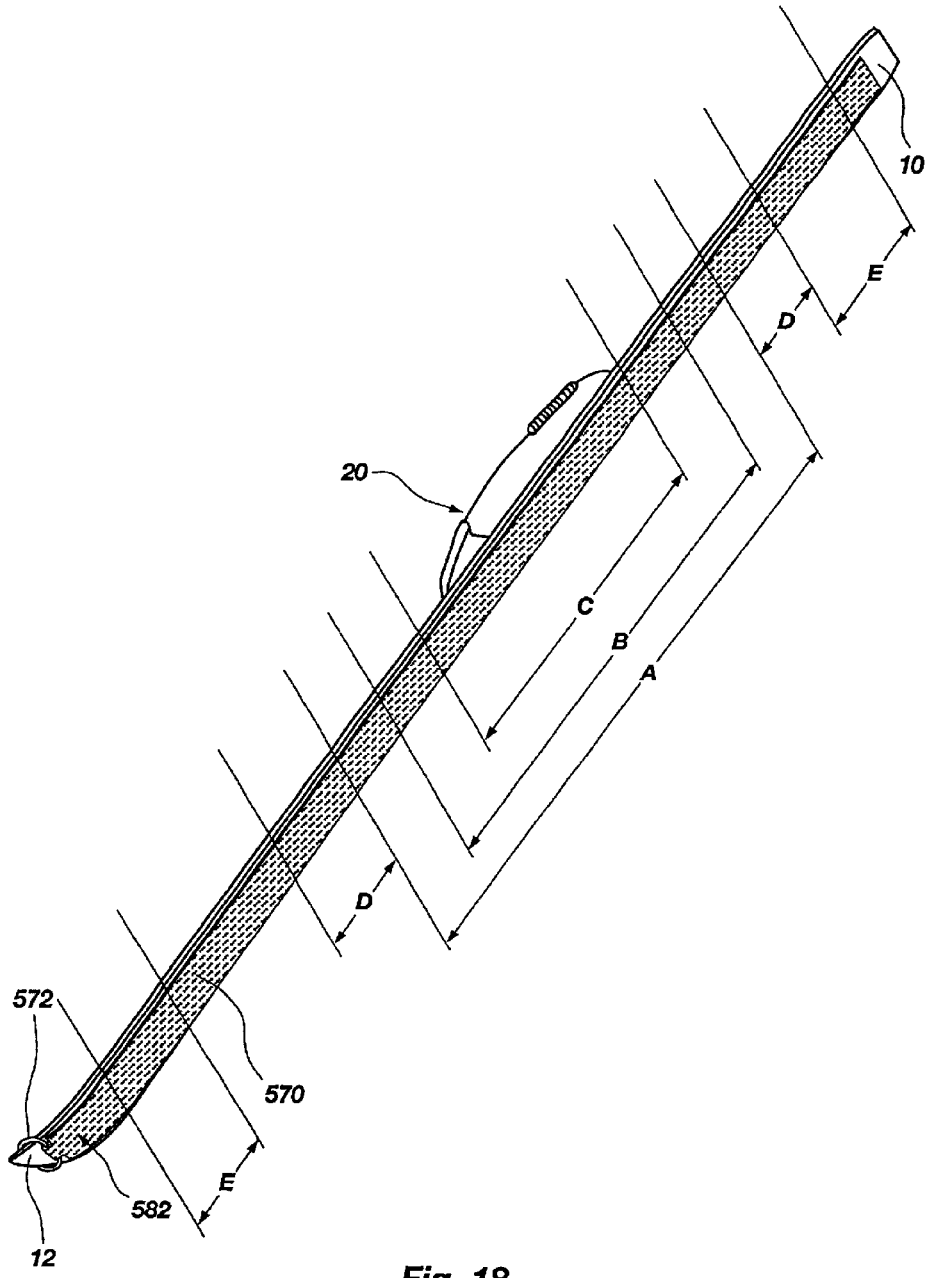
FIG. 18 is a perspective view the ski represented in FIG. 14 showing alternative embodiments of the present invention installed thereon.

The fifth embodiment of the present invention, illustrated in FIG. 18, may also be advantageously used by including one or more shortened lengths of the friction enhancing fabric, such as friction enhancing fabric 570 represented in FIG. 14, exemplary shortened lengths of friction enhancing fabric being represented by the lengths designated A–E in FIG. 18. Each of the illustrated lengths has its own characteristics that may be utilized at various times by selective placement of the friction enhancing fabric 570 on the ski 10 or other snow-traveling device.

For example, as shown in FIG. 18, length A is a shortened section of the friction enhancing fabric 570 that does not utilize hoop 572 or any other piece of hardware, but instead relies on the adhesive layer 574 alone, which temporarily bonds the friction enhancing fabric 570 to the ski 10 or other snow-traveling device. Thus, in accordance with the present invention, the friction enhancing fabric 570 may be placed onto a variety of snow-traveling devices for improving human mobility on congealed precipitation without any prior preparation of the snow-traveling device. Even lengths shorter than length A, such as lengths B and C, can be used as a one-piece fabric to increase the friction between congealed precipitation surfaces and a snow-traveling device.

As is known in the art, the ski 10 is formed such that the area of the ski upon which the binding 20 is mounted is formed so that it is biased away from the surface of the snow. As further examples of benefits and versatility of the present invention, the lengths of friction enhancing fabric A–C (FIG. 18) may be positioned on the ski 10, below the binding 20 such that when a downward force is applied by the weight of the user, the contacting surface of the ski 10, which bears the friction enhancing fabric 570, flattens and directly contacts the congealed precipitation. The contact between the friction enhancing fabric 570 and the congealed precipitation surface increases the amount of friction between the ski 10 and the congealed precipitation surface so that when a downward force is applied when climbing an incline the additional friction allows the portion of the ski 10 bearing the friction enhancing fabric 570 to grip the congealed precipitation surface, increasing traction for the user. When the downward force is no longer applied, for example when proceeding downhill, the middle portion of the ski 10, tends to lift up and away from the congealed precipitation surface, at least somewhat disengaging the friction enhancing fabric 570. It should be noted that a combination of lengths may also be used similarly, for providing specific gripping areas and surfaces, which the user deems appropriate, to increase traction as illustrated by lengths D and E. Thus, it will be appreciated that the embodiments of the present invention provide advantages not possibly attained with previously available devices.

Figure 17:
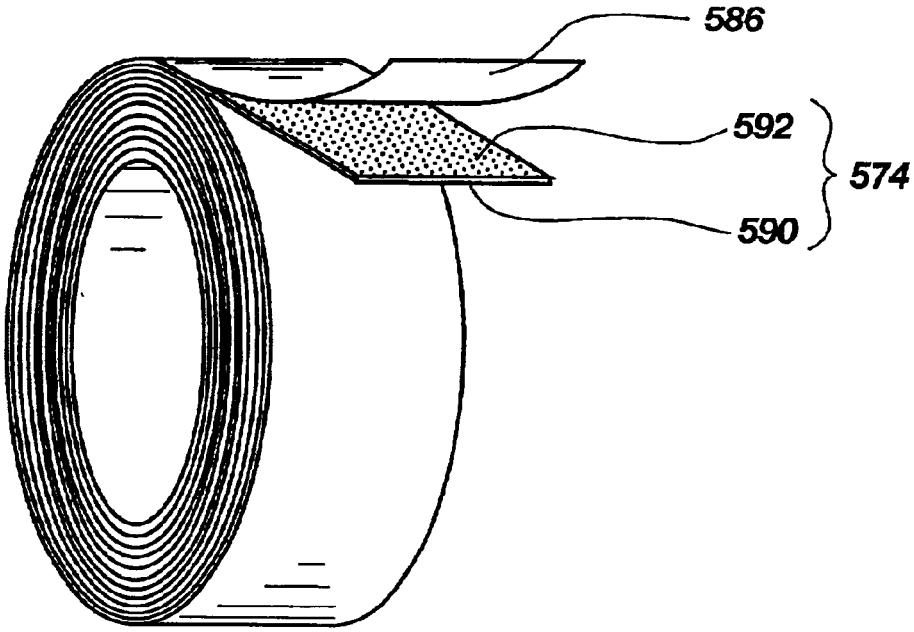
FIG. 17 is perspective view of one example of the adhesive material used in the fifth embodiment in accordance with the present invention.

The adhesive layer 574 (best seen in the cross sectional view of FIG. 16) is used to adhere all lengths of the friction enhancing fabric 570 to the ski 10. The preferred structure for the adhesive layer 574 is a double-sided adhesive tape with a first side 590 of the tape (seen best in FIG. 17) being attached to the friction enhancing fabric 570 and a second side 592 being selectively adhered to the base of the ski 10. The second side 592 of the tape, which contacts the base of the ski 10 has release material 586 (seen best in FIG. 17), which allows the fabric 570 to be rolled up (without interfering with the adhesive function) into a small, convenient size for transporting on a back country ski trip and to be selectively attached to the ski 10 when needed at anytime during the ski trip. Those skilled in the art can readily select numerous double-sided adhesive tapes, as well as other structures which are now known in the industry or which may become known in the future, which can be readily utilized in accordance with the present invention. It is preferred that such double-sided adhesive tape have sufficient bonding strength to maintain adhesion during use, and when wet, yet still be readily removable by the user without leaving an undesirable residue on the ski 10. The friction enhancing fabric 570 is preferably stored with the double-sided adhesive tape adhered to the friction enhancing fabric 570 and prepared for installation by removing the release material 586 (seen best in FIG. 17) and then attaching the friction enhancing fabric 570 to the ski or other snow-traveling device by the user applying hand pressure to the friction enhancing fabric 570 causing the adhesive layer 574 to adhere to the snow traveling device in the position desired by the user.

Other adhesives may also be used for selectively attaching the friction enhancing fabric 570 to the ski 10 and use of such adhesives are within the scope of the present invention. For example aerosols, films, hot melt, liquids, pastes, double coated film and paper tapes, double coated foam tapes, adhesive transfer tapes, spray adhesives or gelatinous adhesives might be used to accomplish the same desired result as the described double-sided adhesive tape. It will be appreciated that the materials disclosed herein are merely examples of preferred adhesive materials which can function equivalently to adhesive layer 574, and other adhesives may be selected by one of ordinary skill in the art to accomplish the desired result.

The preferred adhesive layer 574 described above can be obtained from a number of different manufacturers specializing in adhesives, tapes for bonding, and reclosable fasteners, such as the 3M™ Corporation. 3M™ Corporation manufacturers various industrial and manufacturing tapes for bonding a wide variety of materials together. One such family of products is manufactured by 3M™ Corporation, and is known as 3M™ Double Coated Tapes, further details of which can be found at http://www.3m.com/us/index.jhtml.

The adhesive layer 574, which is used to connect the friction enhancing fabric 570 to the underside contacting surface of the snow-traveling device, is merely one example of a means for adhering the first side of the friction enhancement means to the contacting surface of the snow-traveling device. Many other types of adhesive materials, such as other double-sided adhesive tapes, spray adhesives and gelatinous adhesives, may function as the adhesive layer 574. It will now be appreciated that the adhesive layer 574 disclosed herein is merely one example of a structure for connecting the friction enhancing fabric 570 to the snow-traveling device and it should be appreciated that any structure, apparatus or system for connecting the friction enhancing fabric 570 to the snow-traveling device which performs functions the same as, or equivalent to, those disclosed herein are intended to fall within the scope of the present invention. Advantageously, the adhesive layer 574 allows the friction enhancing fabric 570 to attach to the ski 10 without the need to permanently attach a connector at either end of the ski 10.

Figure 15:
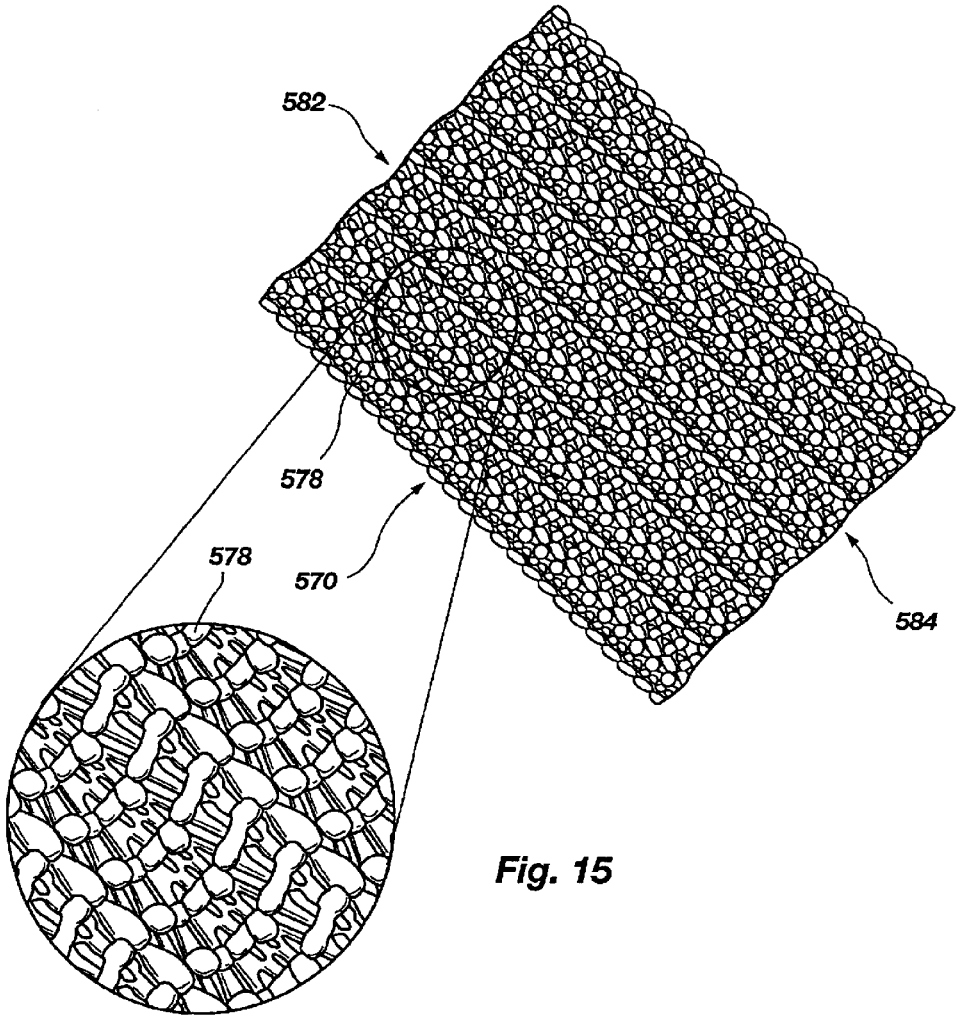
FIG. 15 is a detailed view of the fifth embodiment of the present invention shown in FIG. 14 wherein the texture of the surface which contacts the snow is illustrated.

FIG. 15 provides a detailed view of the friction enhancing fabric 570 taken along the lines 15—15 in FIG. 14. One preferred pattern of the friction enhancing fabric 570 is a woven design, which enhances friction and enhances controlled movement of a user on the ski 10 by increasing friction between the contacting surface and the congealed precipitation surface. The design of the friction enhancing fabric 570 is such that when viewing the woven pattern of the friction enhancing fabric 570 from either the first end 582 or the second end 584, the pattern is generally the same in each direction. It will be appreciated that other suitable arrangements known or readily ascertainable, to those skilled in the art, may be used and are within the scope of the present invention.

FIG. 15 provides a detailed view of the preferred material for the friction enhancing fabric 570 and an enlarged view of the pattern of the friction enhancing fabric 570 is shown in the window of FIG. 15. The friction enhancing fabric 570 is illustratively formulated from a polyester 576 (seen best in FIG. 16) that is made in a woven design with a certain amount of resiliency and forms a substrate, which is coated with a polyvinyl chloride foam formed into globules 578. The globules 578 of the polyvinyl chloride foam are placed about the polyester 576 weave to produce a surface for enhancing the friction between the friction enhancing fabric 570 and the congealed precipitation surface. The woven polyester 576 substrate with polyvinyl chloride foam globules 578 is advantageous for increasing human mobility on congealed precipitation because the fabric is inexpensive to produce, is waterproof, provides a non-slip surface, and functions and bonds well to snow traveling devices to provide a structure which increases friction between the friction enhancing fabric 570 and the congealed precipitation surface. It will be appreciated that other designs may be utilized for the friction enhancing fabric 570, such as a slant pile design, and those skilled in the art will be able to select such other designs, all of which are intended to fall within the scope of the present invention. For example, a substrate made of plastic, in any one of its various forms, or other material which is capable of bonding with a material known for enhancing friction between the substrate and the surface of the congealed precipitation is within the scope of the present invention.

Whatever material is ultimately selected in accordance with the present invention for increasing traction on congealed precipitation, the material should comprise two features. First, the material should increase the traction capabilities on congealed precipitation surfaces, and second, the material should be capable of adhering, not only to the adhesive layer 574, but also to the snow-traveling device under stress and in snowy, wet conditions at a variety of temperature ranges.

Moreover, the friction enhancing fabric 570 may be manufactured using different materials and designs. Illustratively, the preferred friction enhancing fabric 570 may be manufactured from essentially two layers, the first layer having a honeycomb pattern (not shown) as the friction enhancing fabric's 570 base, which may be formulated from the woven polyester 576 or other material known to one skilled in the art, with the second additional layer containing a friction enhancing material, such as the polyvinyl chloride foam globules 578 (shown best in the window of FIG. 15). It will be appreciated that other suitable arrangements known or readily ascertainable, to those skilled in the art, may be used to accomplish similar results using a different mode of manufacture and are all within the scope of the present invention.

The preferred friction enhancing fabric 570 can be obtained from a number of different manufacturers specializing in foam fabrication. One such manufacturer is S & S Plastics, Inc. located at 310 Sherman Avenue, Newark, N.J. 07114 U.S.A., and information regarding S & S Plastics, Inc. can be found on the world wide web at the following address: http://www.ssplastics.com/home.html. The most preferred fabric is currently available from American Non-Slip Products, Inc. located at 6775 Meadow Lane, Alpharetta, Ga. 30005 U.S.A., and information regarding American Non-Slip Products, Inc. can be found on the world wide web at the following address: http://www.americannonslip.com/, the most preferred fabric is available under the trademark RUG-LOC® which is manufactured by American Non-Slip Products, Inc. It should be noted that other products available on the market, and specifically those products manufactured by American Non-Slip Products, Inc., containing a polyvinyl chloride foam surface may be utilized and are intended to fall within the scope of the present invention.

Now referring to FIG. 16, which shows that the friction enhancing fabric 570 itself is dual-sided, one side of the friction enhancing fabric 570 comprising a woven polyester 576 coated with polyvinyl chloride foam globules 578, or other material which can selected by one skilled in the art, and the opposite side containing an adhesive layer 574 to keep the friction enhancing fabric 570 from moving or slipping while in use. FIG. 16 provides a side view of the back end of the ski 10 with the fabric mounted to said ski 10, wherein the polyester 576 is shown as a thin layer between the adhesive layer 574 and the polyvinyl chloride foam globules 578, wherein the polyvinyl chloride foam globules 578 attach to the polyester 576 substrate. The polyvinyl chloride foam globules 578 provide the necessary friction, as described above, to enhance the user's ability to climb on congealed precipitation surfaces.

The woven polyester 576, which is coated with polyvinyl chloride foam globules 578 to form the preferred friction enhancing fabric 570, is relatively inexpensive to produce, is lightweight and can easily be folded into a small bundle for packing and storage. In addition, the friction enhancing fabric 570 can easily be attached, removed and disposed of without the expense and permanent attachment structures required by traditional friction enhancing fabrics.

The polyester 576 and the polyvinyl chloride foam globules 578 used to enhance friction is one example of a friction enhancement means for enhancing friction providing that the friction between the snow-traveling device and the congealed precipitation surface is substantially increased, in accordance with the present invention. It will be appreciated that the system for providing enhanced friction disclosed herein is merely one example of structures providing friction between the snow-traveling device and the congealed precipitation surface, and other suitable materials and arrangements known or readily ascertainable to those skilled in the art for enhancing friction may be used and are within the scope of the present invention.

Figure 19:
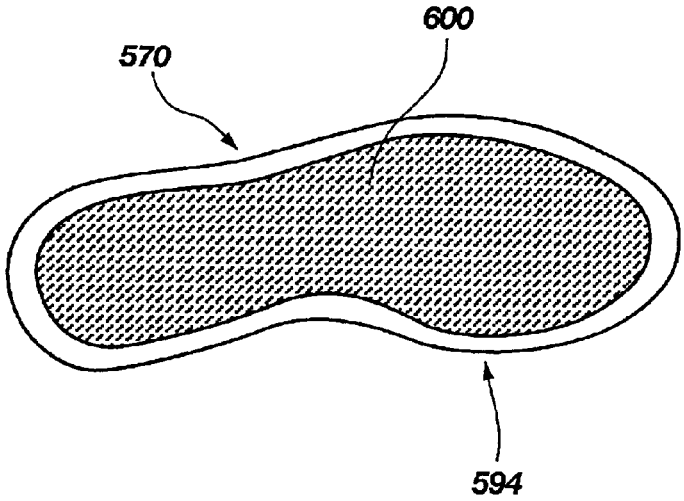
FIG. 19 is a bottom view of exemplary footwear showing another embodiment of the present invention installed thereon.
Figure 19A:
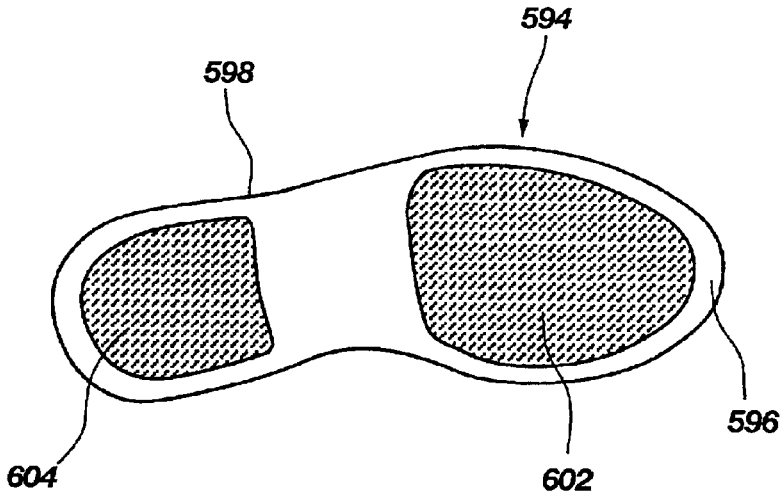
FIG. 19A provides a bottom view of exemplary footwear, similar to that shown in FIG. 19, with another embodiment of the present invention installed thereon.
Figure 20:
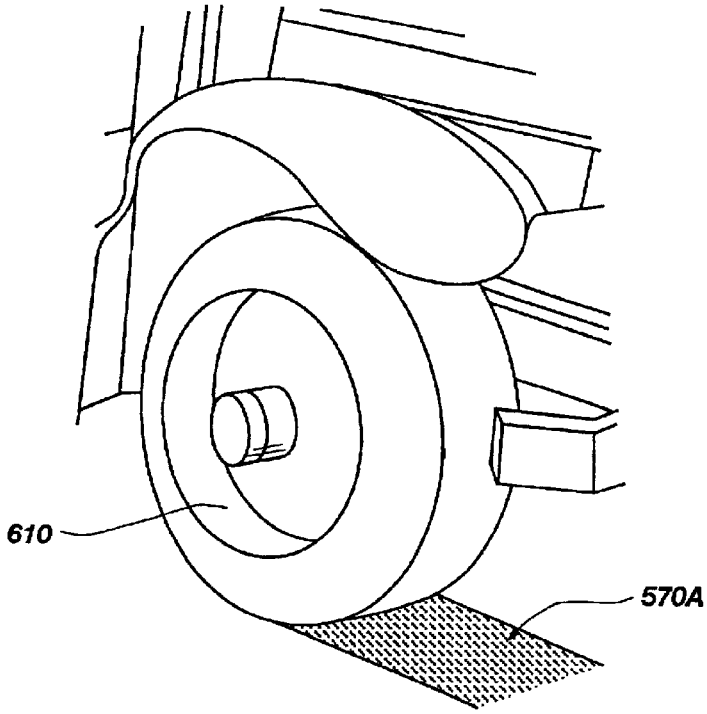
FIG. 20 is a perspective view another illustrative embodiment of the present invention being installed on an automobile tire.
Figure 21:
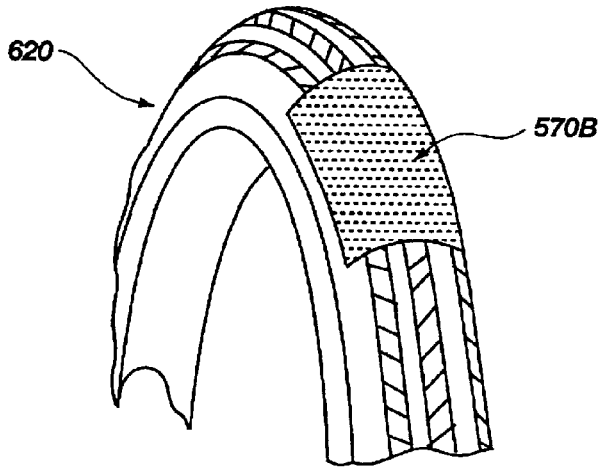
FIG. 21 is a perspective view another illustrative embodiment of the present invention installed on a bicycle tire.

Referring now to FIGS. 19–21, other embodiments of the present invention which utilize friction enhancing fabric 570 are illustrated. It is to be understood that many of the considerations discussed above in connection with the embodiments represented in FIGS. 14–18 also apply to the embodiments of the present invention illustrated in FIGS. 19–21. The embodiments of the present invention illustrated in FIGS. 19–21 include application of a friction enhancing fabric, such as the friction enhancing fabric 570 described earlier, on the sole (indicated generally at 594 in FIGS. 19 and 19A) of footwear, such as shoes, to reduce slippage on a slippery surface, such as the surface of congealed precipitation and as traction enhancing structures for a motor vehicle tire 610 (FIG. 20) when encountering icy conditions, and on a bicycle tire, generally indicated at 620, allowing a bicycle to more safely ridden in icy and/or snowy conditions. It will be understood that the embodiments of the present invention represented in FIGS. 19–21 which utilize a friction enhancing fabric provide improved human mobility on congealed precipitation surfaces and are accomplished using inexpensive materials, thus providing advantages not heretofore available in the industry.

FIGS. 19 and 19A, specifically show a friction enhancing fabric applied on the soles of footwear, such as shoes or boots, for reducing slippage during cold, icy weather. Various shoe styles and sizes may be accommodated by using either a one-piece 600 (preferred when the entire sole of the footwear, including the heel, is substantially planar as illustrated in FIG. 19) or a multiple-sectioned pieces of friction enhancing fabric, such as represented at represented at 602 and 604 in FIG. 19A, preferred for use when the heel portion is formed separately from the remainder of the sole of the footwear. The multiple-sections of friction enhancing fabric represented at 602 and 604 comprises a toe section 602 and a heel portion 604 for separate attachment to a sole 594 of the shoe to accommodate differing levels of the toe 596 and the heel 598 of the footwear so as to reduce the potential for detachment of the friction enhancing fabric from the sole 594 or tearing of the friction enhancing fabric.

FIGS. 20 and 21 illustrate friction enhancing fabric patches 570A and 570B placed on an motor vehicle tire 610, and a bicycle tire 620, respectively, in accordance with the present invention. As used in conjunction with an automobile tire 610, the friction enhancing fabric 570A may be placed directly underneath the tire 610, as shown in FIG. 20, on a slippery surface when the tire 610 is slipping and unable to gain enough traction for propelled motion. Alternatively, the friction enhancing fabric patch 570A can be adhered to the tread of the tire 610 using one of the adhesive techniques described earlier so that nearly all of the circumference of the tread of the tire 610 is provided with the friction enhancing fabric. The friction enhancing fabric patch 570A, thus provides the necessary friction for the motor vehicle to gain traction and move the motor vehicle. Additionally, because the friction enhancing fabric patch 570A is inexpensive to produce, the fabric is suitable for storage in the motor vehicle until needed for one time use.

Likewise, as illustrated in FIG. 21, the friction enhancing fabric patch 570B may be attached to the bicycle tire 620 to improve traction in slippery, wet conditions. FIG. 21 illustrates a friction enhancing fabric patch 570B adhered to the bicycle tire 620. Applying the friction enhancing fabric patch 570B to the bicycle tire 620 increases the friction between a slippery surface and the friction enhancing fabric 570, thereby increasing traction. It is within the scope of the present invention to also adhere the friction enhancing fabric patch 570B so that it encircles substantially all of the circumference of the bicycle tire 620 or to place numerous friction enhancing patches 570B about the circumference of the bicycle tire 620 in a spaced apart relationship.

Figure 22:
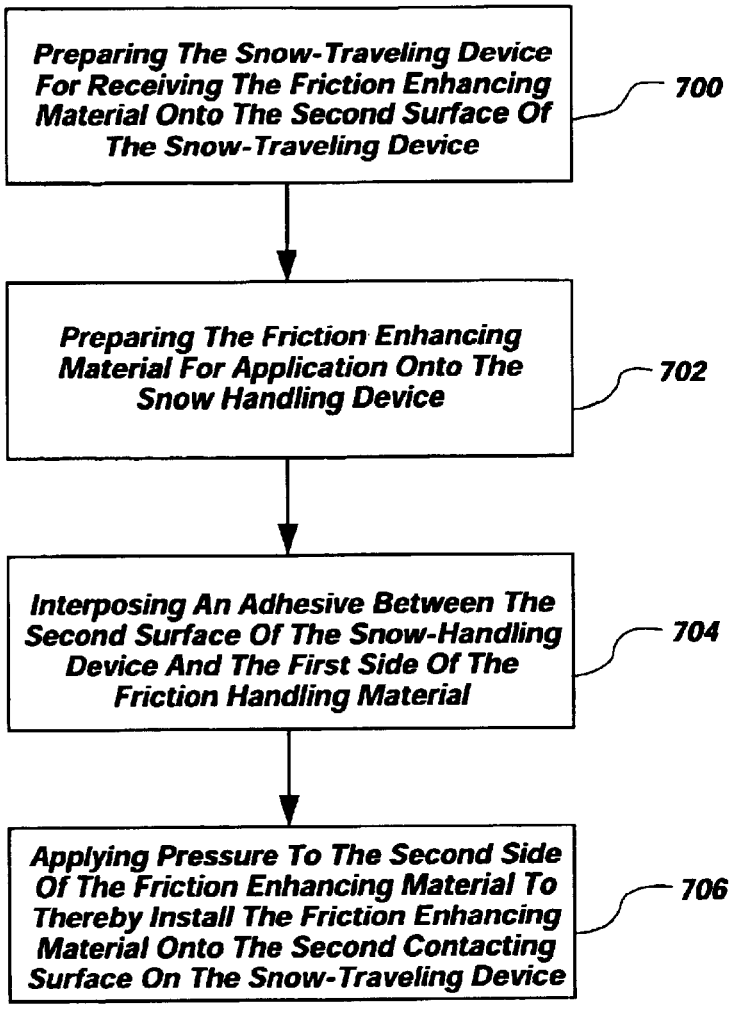
FIG. 22 is a flow chart showing the steps carried out in accordance with one illustrative embodiment of the present invention.

Reference will now be made to the exemplary flow diagram of FIG. 22. In one illustrative embodiment of the present invention there is represented an illustrative method to apply a friction enhancing material to a snow-traveling device. The first step is to prepare the snow-traveling device for receiving the friction enhancing material onto a second contacting surface of said snow-traveling device (step 700). The next step is to prepare the friction enhancing material for application onto the snow-traveling device to thereby increase the friction between the congealed precipitation surface and the snow-traveling device (step 702). The next step is to interpose an adhesive between the second contacting surface of the snow-traveling device and a first side of the friction enhancing material to releasably adhere the friction enhancing material to the snow-traveling device (step 704). The final step is to apply pressure to the second side of the friction enhancing material to thereby install the friction enhancing material onto the second contacting surface on the snow-traveling device by placing the adhesive substance into close contact with both the snow-traveling device and the flexible fabric whereby the friction between the second contacting surface and the congealed precipitation surface is enhanced (step 706).

Figure 23:
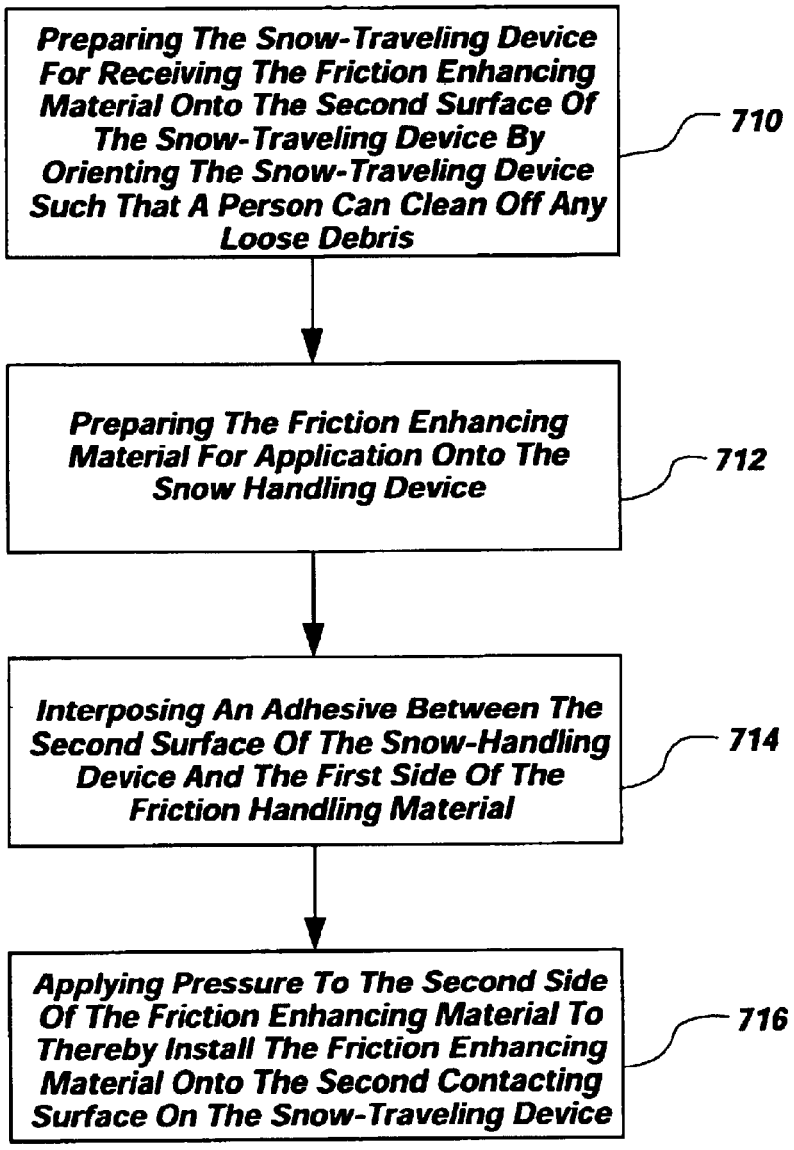
FIG. 23 is a flow chart showing the steps carried out in accordance with one illustrative embodiment of the present invention.

Reference will now be made to the exemplary flow diagram of FIG. 23. In one illustrative embodiment of the present invention there is represented an illustrative method to apply a friction enhancing material to a snow-traveling device. The first step is to prepare the snow-traveling device for receiving the friction enhancing material onto a second contacting surface of said snow-traveling device by orientating the snow-traveling device such that a person can clean off any loose debris (step 710). The next step is to prepare the friction enhancing material for application onto the snow-traveling device to thereby increase the friction between the congealed precipitation surface and the snow-traveling device (step 712). The next step is to interpose an adhesive between the second contacting surface of the snow-traveling device and a first side of the friction enhancing material to releasably adhere the friction enhancing material to the snow-traveling device (step 714). The final step is to apply pressure to the second side of the friction enhancing material to thereby install the friction enhancing material onto the second contacting surface on the snow-traveling device by placing the adhesive substance into close contact with both the snow-traveling device and the flexible fabric whereby the friction between the second contacting surface and the congealed precipitation surface is enhanced (step 716).

Figure 24:
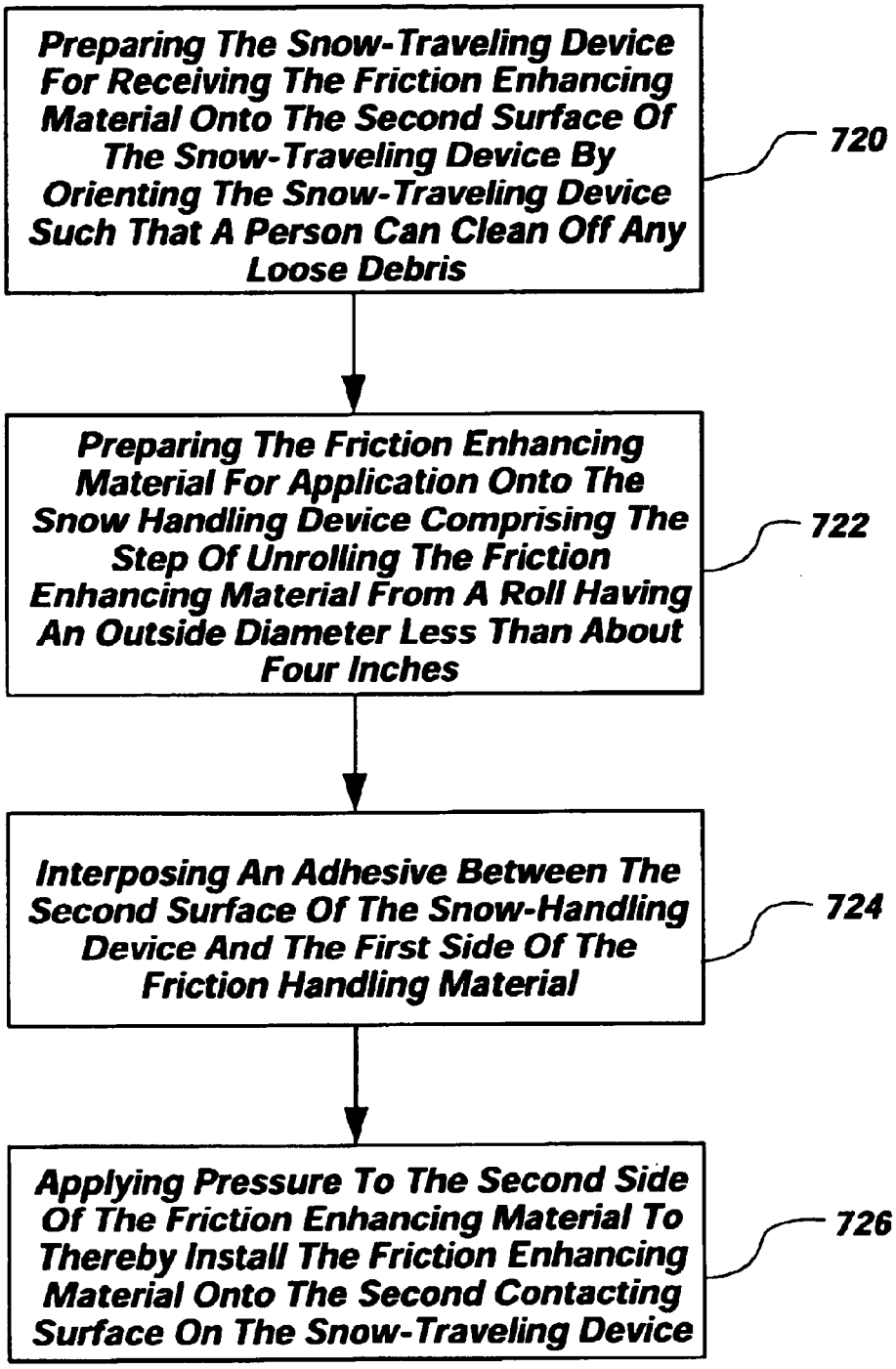
FIG. 24 is a flow chart showing the steps carried out in accordance with one illustrative embodiment of the present invention.

Reference will now be made to the exemplary flow diagram of FIG. 24. In one illustrative embodiment of the present invention there is represented an illustrative method to apply a friction enhancing material to a snow-traveling device. The first step is to prepare the snow-traveling device for receiving the friction enhancing material onto a second contacting surface of said snow-traveling device by orientating the snow-traveling device such that a person can clean off any loose debris (step 720). The next step is to prepare the friction enhancing material for application onto the snow-traveling device to thereby increase the friction between the congealed precipitation surface and the snow-traveling device comprising the step of unrolling the friction enhancing material from a roll having an outside diameter less than about four inches (step 722). The next step is to interpose an adhesive between the second contacting surface of the snow-traveling device and a first side of the friction enhancing material to releasably adhere the friction enhancing material to the snow-traveling device (step 724). The final step is to apply pressure to the second side of the friction enhancing material to thereby install the friction enhancing material onto the second contacting surface on the snow-traveling device by placing the adhesive substance into close contact with both the snow-traveling device and the flexible fabric whereby the friction between the second contacting surface and the congealed precipitation surface is enhanced (step 726).

In view of the foregoing, it will be appreciated that in accordance with the present invention, the friction enhancing fabric is particularly beneficial when utilized with a split snowboard. A split snowboard is an example of a snow-traveling device that combines the climbing aspect of cross country skiing with the downhill aspect of snowboarding. Split snowboards have the ability to be separated into two individual pieces to allow a user to better negotiate uphill climbs, and also to reattach the two pieces to form a snowboard for downhill travel and enjoyment. To improve the ability of a user to climb with these split snowboards, the friction enhancing fabric may be dimensioned and configured for incorporation onto a split snowboard. As previously discussed, after application onto the split snowboard, the friction enhancing fabric increases the amount of friction between the congealed precipitation surface and the contacting surface of the split snowboard improving the user's traction and ability to climb. As described above, all of the illustrative uses for the friction enhancing fabric improve the ability of a user to move about congealed precipitation surfaces, such as snow and ice, while not detracting the functioning or appearance of the snow-traveling device when enhanced traction is no longer needed.

In accordance with another aspect of the present invention, the described friction enhancing fabrics can be advantageously used to increase friction of a glove for the human hand. In particular, gloves used by mountain climbers or rock climbers must have a gripping surface which provides maximum friction between the fingers and palm of the user and rock surfaces, which in some instances are wet or icy. It will be appreciated that using the information provided herein, one skilled in the art can structure the friction enhancing fabric so it is adhered to the surface of a glove, and particularly gloves which are know in the art for use during rock climbing or mountain climbing. Alternatively, the desirable characteristics of the friction enhancing fabric can be permanently incorporated into a glove using the information provided herein.

In view of the forgoing, it will be appreciated that the present invention provides a friction enhancing structure which is easily attached to, and detached from, a snow-traveling device without the need for permanent accessories that can cause permanent damage to the snow-traveling device when removed.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with illustrative embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method of applying a friction enhancing material to a snow-traveling device, said snow-traveling device having a first surface for engaging a human and a second contacting surface for contacting a congealed precipitation surface, said friction enhancing material comprising a first side and a second side, and said friction enhancing material further comprising a woven slant pile pattern having a uniform weave of polyester coated with droplet shaped beads of polyvinyl chloride for engaging the congealed precipitation surface, said method comprising the steps of:

preparing the snow-traveling device for receiving the friction enhancing material onto the second contacting surface of said snow-traveling device;

preparing the friction enhancing material for application onto the snow-traveling device to thereby increase the friction between the congealed precipitation surface and the snow-traveling device;

interposing an adhesive between the second contacting surface of the snow-traveling device and the first side of the friction enhancing material to releasably adhere the friction enhancing material to the snow-traveling device; and applying pressure to the second side of the friction enhancing material to thereby install the friction enhancing material onto the second contacting surface on the snow-traveling device by placing the adhesive substance into close contact with both the snow-traveling device and the friction enhancing material whereby the friction between the second contacting surface and the congealed precipitation surface is enhanced.

2. A method of applying a friction enhancing material to a snow-traveling device as defined in claim 1 wherein said friction enhancing material has a first dimension and a second dimension, said uniform weave comprises a pattern that is the same when viewed in the first dimension and in the second dimension.

3. A method of applying a friction enhancing material to a snow-traveling device as defined in claim 1 wherein said adhesive at least one chosen from the group consisting of: spray adhesive, double-sided adhesive tape, and a gelatinous adhesive.

4. A method of applying a friction enhancing material to a snow-traveling device as defined in claim 3 wherein said adhesive releasably affixes said friction enhancing material to the snow-traveling device whereby the friction enhancing material is held in place and is kept from moving in relation to the snow-traveling device as the snow-traveling device is maneuvered on the congealed precipitation surface.

5. A method of applying a friction enhancing material to a snow-traveling device as defined in claim 1 wherein said step of preparing the snow-traveling device further comprises the step of orienting the snow-traveling device such that any loose debris on the second contacting surface of the snow-traveling device can be cleaned off.

6. A method of applying a friction enhancing material to a snow-traveling device as defined in claim 5 wherein said step of preparing the friction enhancing material further comprises the step of unrolling the friction enhancing material from a roll having an outside diameter less than about four inches.

7. A method of applying a friction enhancing material to a snow-traveling device as defined in claim 6 wherein said step of preparing the friction enhancing material further comprises the step of exposing the adhesive such that the friction enhancing material can be affixed to the snow-traveling device.

8. A method of applying a friction enhancing material to a snow-traveling device as defined in claim 7 wherein said step of preparing the snow-traveling device further comprises the step of holding said snow-traveling device such that said friction enhancing material can be detachably affixed to the snow-traveling device.

9. A method of applying a friction enhancing material to a snow-traveling device as defined in claim 1 wherein said friction enhancing material further comprises a first end and a second end, said friction enhancing material further comprising a fastener provided at its first end and adapted for fastening the friction enhancing material to the snow-traveling device.

10. An apparatus for improving human mobility on congealed precipitation when a human is utilizing a snow-traveling device, the snow-traveling device having a first end, a second end and a contacting surface, said apparatus comprising:

a friction enhancement means for enhancing friction between the contacting surface of said snow-traveling device and the congealed precipitation, said friction enhancement means comprising a woven polyester coated with polyvinyl chloride droplets;

a first side provided on the friction enhancement means adapted for making contact with the snow-traveling device;

a second side provided on the friction enhancement means for contacting the congealed precipitation surface; and means for adhering the first side of said friction enhancement means to the contacting surface of the snow-traveling device to increase the friction between the snow-traveling device and the congealed precipitation to improve mobility of the human on the congealed precipitation.

11. An apparatus for improving human mobility on congealed precipitation as defined in claim 10 wherein said woven polyester has a pattern, a first dimension and a second dimension, the pattern being the same when viewed in the first dimension and as when viewed in the second dimension.

12. An apparatus for improving human mobility on congealed precipitation as defined in claim 10 wherein said apparatus has a first dimension and a second dimension, said friction enhancement means having droplets protruding out therefrom such that the droplets protrude into the congealed precipitation when in use.

13. An apparatus for improving human mobility on congealed precipitation as defined in claim 12 wherein the friction enhancement means comprises a woven pattern which is the same when viewed in the direction of said first dimension and said the direction of said second dimension.

14. An apparatus for improving human mobility on congealed precipitation as defined in claim 10 wherein said means for adhering comprises an adhesive substance.

15. An apparatus for improving human mobility on congealed precipitation as defined in claim 14 wherein said adhesive substance is at least one selected from the group consisting of: spray adhesive, double-sided tape, and gelatinous adhesive.

16. An apparatus for improving human mobility on congealed precipitation as defined in claim 10 wherein said apparatus further comprises a fastener, said fastener attaching the apparatus to the first end of the snow-traveling device.

17. An apparatus for improving human mobility on congealed precipitation when a human is utilizing a snow-traveling device, the snow-traveling device having a first end, a second end and a contacting surface, said apparatus comprising:

a friction enhancement means for enhancing friction between the contacting surface of said snow-traveling device and the congealed precipitation, said friction enhancement means comprising a substrate which is woven and having globules protruding from said substrate to thereby increase the friction between the apparatus and the congealed precipitation surface;

a first side provided on the friction enhancement means adapted for making contact with the snow-traveling device;

a second side provided on the friction enhancement means for contacting the congealed precipitation surface; and means for adhering the first side of said friction enhancement means to the contacting surface of the snow-traveling device to increase the friction between the snow-traveling device and the congealed precipitation to improve mobility of the human on the congealed precipitation.

18. The apparatus of claim 17 wherein the globules comprise polyvinyl chloride.

* * * * *